United States Patent [19]

Nowacki

[11] Patent Number: 4,500,306

[45] Date of Patent: Feb. 19, 1985

[54] METHOD AND APPARATUS FOR ERECTING A CARTON WITH INTEGRAL INTERIOR PARTITIONS

[75] Inventor: Ulrich G. Nowacki, Leisure City, Fla.

[73] Assignee: International Paper Company, New York, N.Y.

[21] Appl. No.: 504,529

[22] Filed: Jun. 21, 1983

Related U.S. Application Data

[63] Continuation-in-part of Ser. No. 393,493, Jun. 29, 1982, abandoned.

[51] Int. Cl.[3] ..... B31B 11/26

[52] U.S. Cl. ..... 493/92; 493/126; 493/130; 493/143; 493/174; 493/912

[58] Field of Search ..... 493/92, 90, 912, 913, 493/174, 167, 126, 130, 138, 141-143, 178, 177, 144, 176

[56] References Cited

U.S. PATENT DOCUMENTS

| | | | |
|---|---|---|---|
| 1,378,581 | 5/1921 | Bernotow . | |
| 1,808,922 | 6/1931 | Gallistel . | |
| 2,391,230 | 12/1945 | Dickerman | 493/92 |
| 2,648,481 | 8/1953 | Belsinger | 229/27 |
| 2,753,770 | 7/1956 | Chapman | 93/53 |
| 2,837,013 | 6/1958 | Pagendarm | 93/36.01 |
| 2,883,915 | 4/1959 | Lloyd | 93/49 |
| 3,082,929 | 3/1963 | Aquino et al. | 229/27 |
| 3,097,576 | 7/1963 | Burke | 93/49 |
| 3,363,824 | 1/1968 | Murata | 229/27 |
| 3,952,634 | 4/1976 | Rollins et al. | 93/49 R |
| 4,292,034 | 9/1981 | Probyn et al. | 493/92 |
| 4,387,549 | 6/1983 | Casutt | 493/92 X |

*Primary Examiner*—James F. Coan

[57] ABSTRACT

An apparatus and method are disclosed for erecting from a single blank a carton having integral interior partitions. Blanks are supplied to the machine and, in three folding stations, are folded along score lines and cuts and then sealed to form the finished carton. Erection of the carton and provision of interior partitions is accomplished by a single machine in a continuous process.

28 Claims, 32 Drawing Figures

56
40
38
44
46
42
62
36
422
446
36'
56'
40'
44'
46'
42'
38'
60
102
228
540
448
454
430
17
408
440
420
418
410
474
146
134
156
452
450
456
462
468
478
476
250
248
472
470
130
236
254

FIG. 25
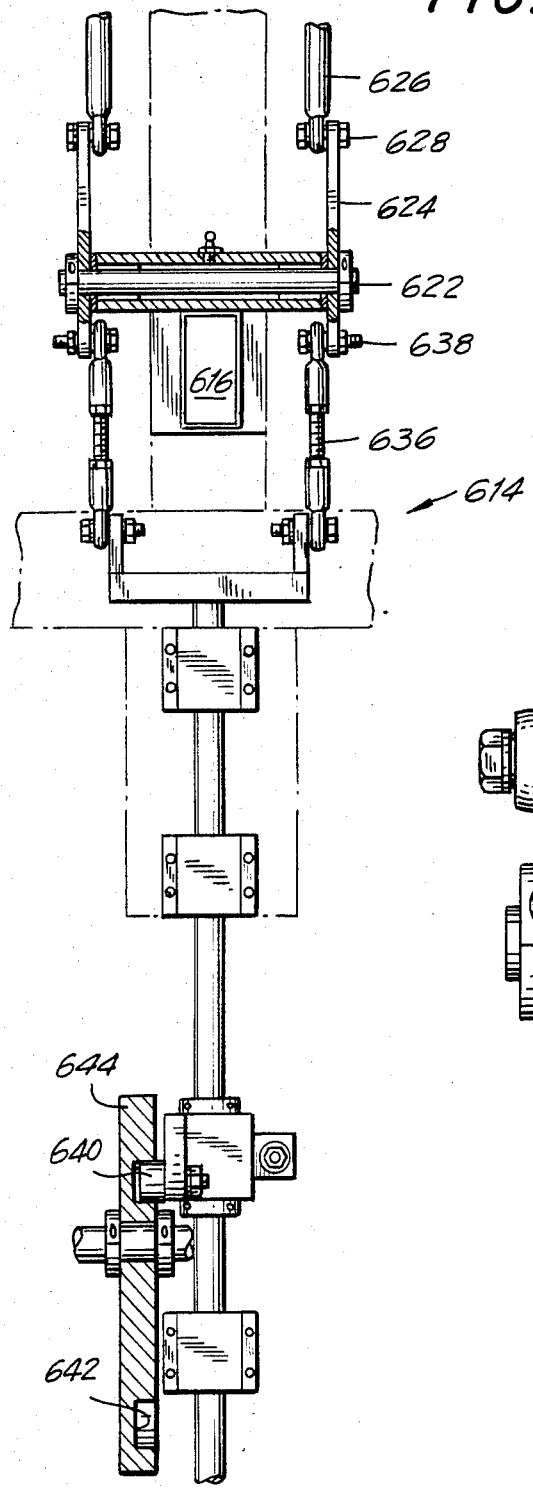
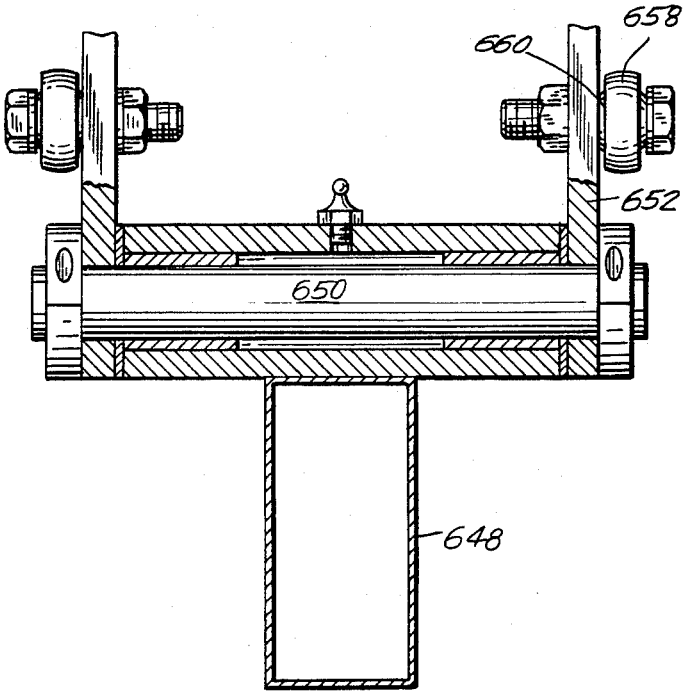
FIG. 26

FIG. 31
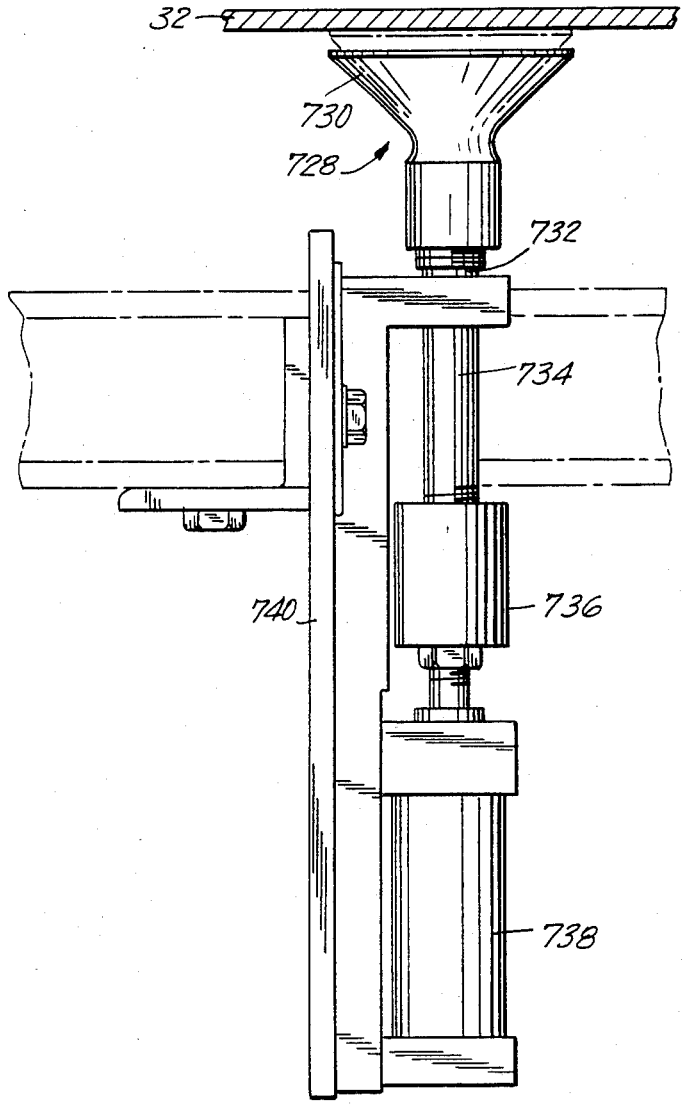
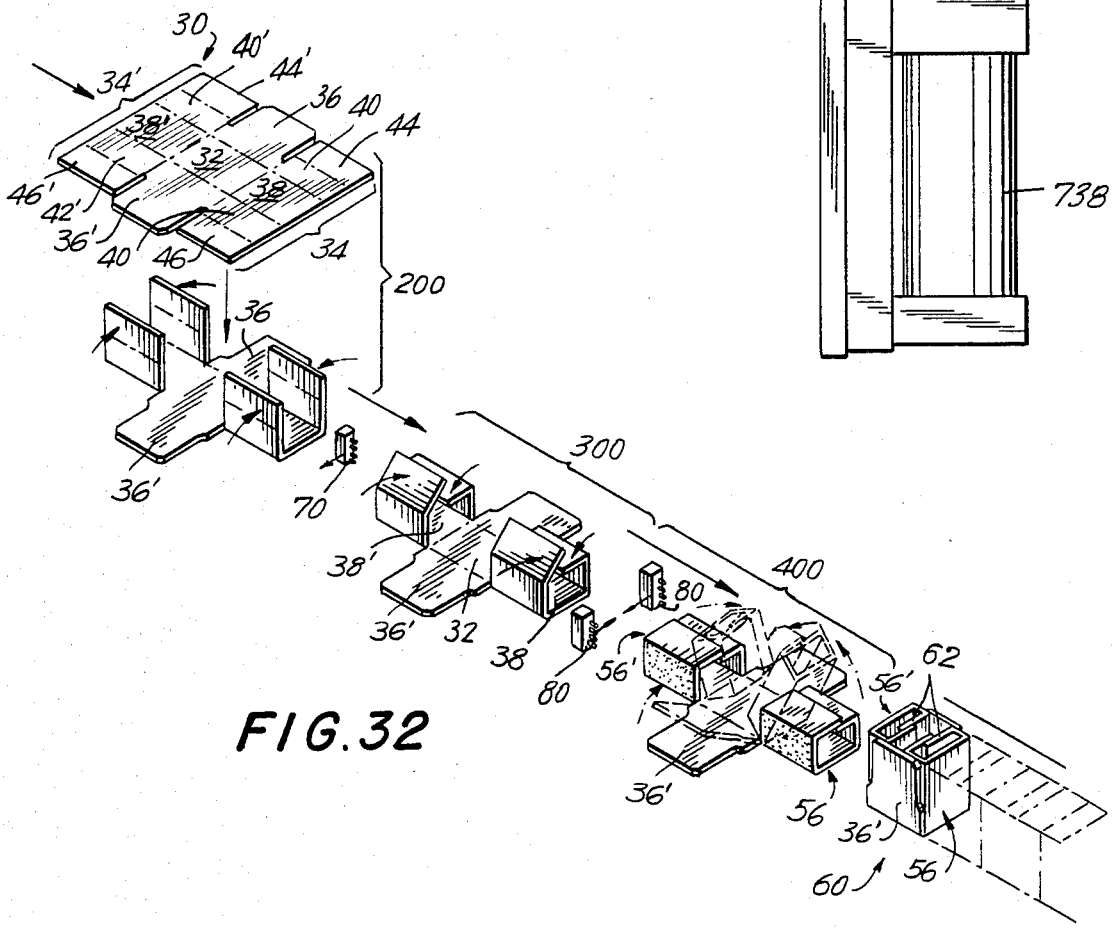
FIG. 32

METHOD AND APPARATUS FOR ERECTING A CARTON WITH INTEGRAL INTERIOR PARTITIONS

This is a continuation-in-part of co-pending application Ser. No. 393,493 filed June 29, 1982 entitled "Method and Apparatus for Erecting a Carton with Integral Interior Partitions", now abandoned.

This invention is in the field of boxes and box-folding. More specifically, this invention relates to a method and apparatus for erecting from a single carton blank a rectangular carton with integral interior partitions.

BACKGROUND OF THE INVENTION

For certain fragile articles, such as bottles and the like, it is desirable to use shipping cartons containing interior partitions to prevent significant movement and breakage of the articles during shipment.

Such shipping cartons can be manufactured in either one or two pieces. The two-piece carton includes the carton itself and one or more separate dividers. Typically, assembly of the two-piece carton requires two pieces of equipment. The first piece of equipment constructs the carton while the second piece of equipment constructs the dividers. The dividers must then be inserted into the carton in order to form the completed carton. The one-piece carton, on the other hand, can be constructed from a single carton blank using one piece of equipment and thus presents a great cost savings over the two-piece carton.

Another advantage of the one-piece carton relates to its inherent durability. The separate dividers of the two-piece carton are not glued or attached to the carton, whereas the one-piece carton has integral and glued partitions making it more durable with greater stacking strength than the two-piece carton.

In addition, manufacturers of articles, such as plastic soda bottles, often ship empty bottles in the constructed carton to a bottler. The bottlers then turn the cartons upside-down to remove the empty bottles for entry into the filling line. With the two-piece carton, the separate dividers tend to slide out or become misaligned during this process. However, in the one-piece carton, the dividers are integral to the carton so that they cannot slide out or become misaligned and thus need no further adjustment when the filled bottles are reloaded into the cartons.

U.S. Pat. Nos. 1,808,922 and 3,082,929 both disclose a single carton blank which can be folded into a rectangular carton with integral interior partitions. Such a single blank comprises a bottom wall, two side portions and two end walls. As suggested in U.S. Pat. No. 3,082,929, the blanks can be erected by folding and sealing the side portions into an open-ended rectangular tubes. The rectangular tubes and end walls are then folded and sealed together to form the completed carton.

The present invention thus relates to an apparatus and method for erecting from a single carton blank a one-piece carton with integral interior partitions by a series of cooperating folding and sealing operations. These operations are performed automatically, efficiently and economically by the apparatus of the present invention. The flat carton blanks can be conveniently and economically shipped to the user who can assemble the carton at the manufacturing location of the articles to be shipped.

The apparatus according to the present invention can be constructed to manufacture cartons of different sizes and each apparatus is adjustable to provide for slight variations in carton size. The apparatus is designed to produce about 25 cartons per minute.

SUMMARY OF THE INVENTION

The present invention relates to a method and machine for manufacturing from a single carton blank a rectangular carton with integral interior partitions. The carton blank is fed into an upper section of a first folding station. A flat plate or ram, depresses the carton blank downward to a lower section of the first folding station. As the ram descends, two pairs of side flaps of the carton blank are erected to a vertical position as a result of contacting with two pairs of vertical plates attached to the lower framework of the machine. The blank is then advanced to a second folding station where the now vertical pair of side flaps are folded around a compression mandrel and sealed to form two open-ended rectangular tubes, which eventually will form two sides and two interior partitions of the completed carton. The blank is then advanced to a third folding station where the two open-ended rectangular tubes are erected vertically. In one embodiment, the remaining two end walls are erected to a vertical position by driving the bottom wall of the carton blank downward by a second ram into a compression area where the raised open-ended rectangular tubes and end walls are sealed together to form the completed carton. In an alternative embodiment, the remaining two end walls are erected by pivotally connected compression pads, which also hold the end walls to the open-ended rectangular tubes to form the completed carton. The various driving parts of the machine may be operated by pneumatic or mechanical or other driving means.

DESCRIPTION OF THE DRAWINGS

FIG. 25 is a sectional view taken along line 25—25 of FIG. 24 showing a side view of the mechanical left flap folder assembly.

FIG. 26 is a sectional view taken along line 26—26 of FIG. 24 showing a side view of the mechanical right flap folder assembly.

FIG. 31 is a sectional view taken along line 31—31 of FIG. 27 showing a side view of the vacuum cup assembly in the third following station.

FIG. 32 is a schematic description of the box folding process in an alternative embodiment.

DETAILED DESCRIPTION OF THE INVENTION

Figure 1:
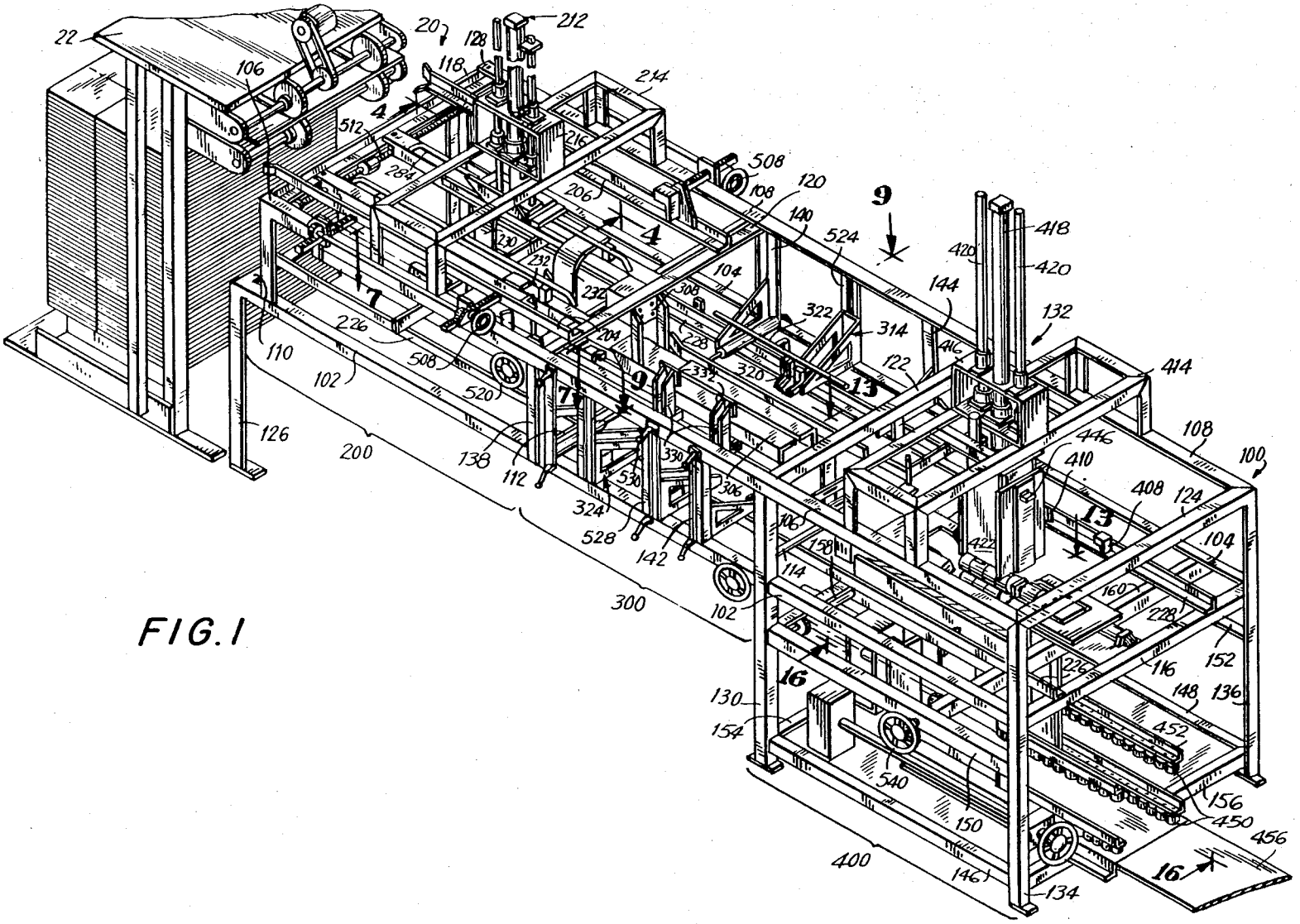
FIG. 1 is a perspective view of an apparatus according to the present invention.

The erecting and sealing apparatus 20 according to the present invention comprises broadly a blank feeding station 22, a first folding station 200, a second folding station 300, and a third folding station 400.

Figure 2:
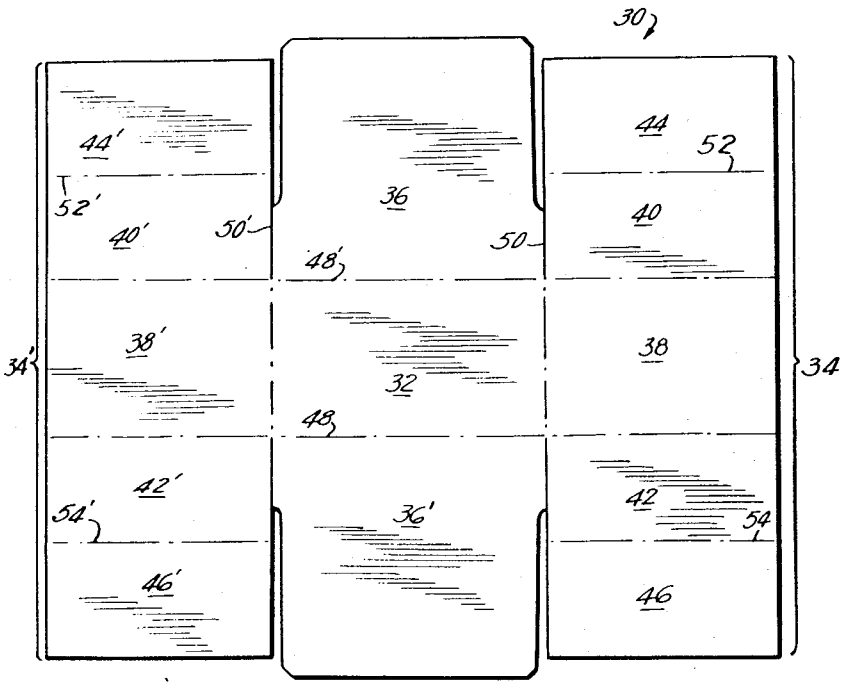
FIG. 2 is a top plan of the flat carton blank.

A carton blank 30 (FIG. 2) is appropriately scored to form sections for erection in the apparatus 20. The carton blank 30 comprises a bottom wall 32, two side portions 34 and 34', and two end walls 36 and 36'. Each side portion 34 and 34' comprises side walls 38 and 38', lower-right flaps 40 and 40', lower-left flaps 42 and 42', upper-right flaps 44 and 44', and upper-left flaps 46 and 46'. Dashed lines in the drawing indicate score lines 48, 48', 50, 50', 52, 52', 54 and 54' in the blank along which folding will occur.

Figure 3:
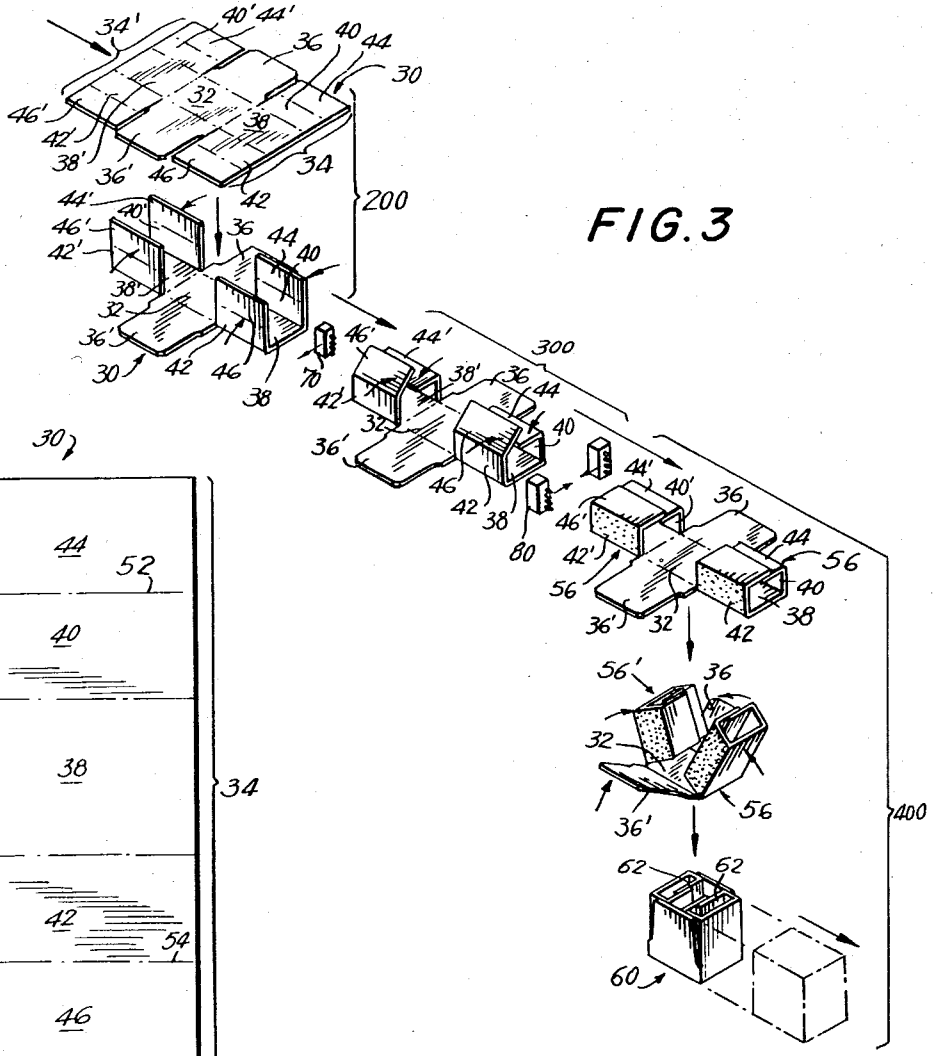
FIG. 3 is a schematic depiction of the box folding process.

FIG. 3 schematically depicts the process of the instant invention wherein the carton blank 30 is erected into a completed carton 60. The carton blank 30 is fed from the blank feeding station 22 to the first folding station 200. With the bottom wall 32, side walls 38 and 38' and end walls 36 and 36' remaining flat, the remaining flaps are erected vertically.

Between the first folding station 200 and the second folding station 300, the partially erected carton blank 30 passes a glue gun 70 which sprays a hot melt adhesive onto the inner surfaces of the upper-left flaps 46 and 46'. At the second folding station 300, the upper-right flaps 44 and 44' are folded into a horizontal position. The previously glued upper-left flaps 46 and 46' are then folded onto the upper-right flaps 44 and 44', thus forming open-ended rectangular tubes 56 and 56'.

Between the second folding station 300 and the third folding station 400, the further erected carton blank 30 passes a pair of glue guns 80 which apply glue to lower-right and lower-left flaps 40, 40', 42 and 42'.

At the third folding station 400, the open-ended rectangular tubes 56 and 56' and end walls 36 and 36' are erected vertically and are sealed together with previously glued lower-right and lower-left flap surfaces 40, 40', 42 and 42' to form the completed carton 60. The completed carton 60 thus comprises a rectangular box containing two integral interior dividers 62, the dividers 62 formed from upper-right and upper-left flaps 44, 44', 46 and 46'.

The apparatus 20 comprises a generally rectangular frame 100 (FIG. 1) having lower longitudinal frame members 102 and 104 and upper longitudinal frame members 106 and 108. The lower longitudinal frame members 102 and 104 are connected in a perpendicular relationship through lower transverse frame members 110, 112, 114, and 116. Similarly, the upper frame members 106 and 108 are connected in a perpendicular relationship through upper transverse frame members 118, 120, 122, and 124. The frame 100 is completed by vertical leg columns 126, 128, 130, 132, 134, and 136 and additional vertical bracing columns 138, 140, 142 and 144.

The boundaries of the three folding stations 200, 300 and 400 can thus be outlined with reference to elements of frame 100. The first folding station 200 is bounded by vertical leg columns 126 and 128, lower and upper longitudinal frame members 102, 104, 106 and 108 to the extent of intersection with vertical bracing columns 138 and 140, and upper and lower transverse frame members 110, 112, 118 and 120. The second folding station 300 is bounded by upper and lower longitudinal frame members 102, 104, 106 and 108 to the extent of intersection with vertical bracing columns 138 and 140 and vertical leg columns 130 and 132, and upper and lower transverse frame members 112, 114, 120 and 122. The third folding station 400 is bounded by upper and lower longitudinal frame members 102, 104, 106 and 108 to the extent of intersection with vertical leg columns 130, 132, 134 and 136, and lower and upper transverse frame members 114, 116, 122 and 124. Additionally, longitudinal frame members 146, 148, 150 and 152 and transverse frame members 154, 156, 158 and 160 are connected between vertical leg members 130, 132, 134 and 136.

The blank feeding station 22 feeds the carton blank 30 onto upper guide rails 204 and 206 which are supported by and slideably affixed to upper transverse frame members 118 and 120. The blank feeding station 22 can be any known and suitable device for providing horizontal carton blanks to a box erecting machine. A pair of squaring stops 208 (FIG. 6) located on the upper guide rails 204 and 206 stop the forward movement of the carton blank 30. A first sensing means, such as photocell (FIG. 4). located on upper guide rail 206, detects a carton blank in the correct position and sends an electrical signal to initiate the first folding step.

Figure 4:
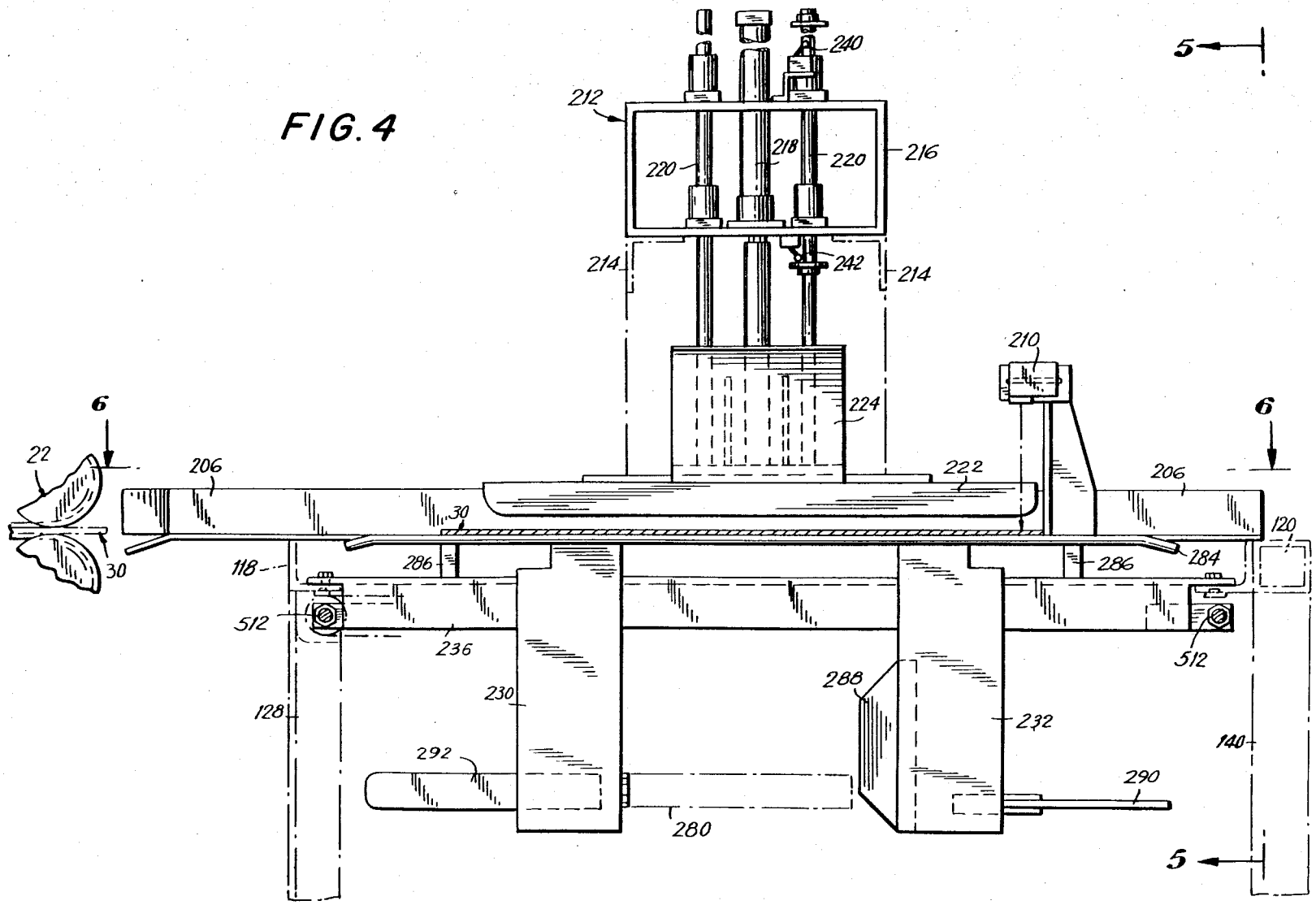
FIG. 4 is a sectional view taken along line 4—4 in FIG. 1 showing a side view of the first folding station.
Figure 22:
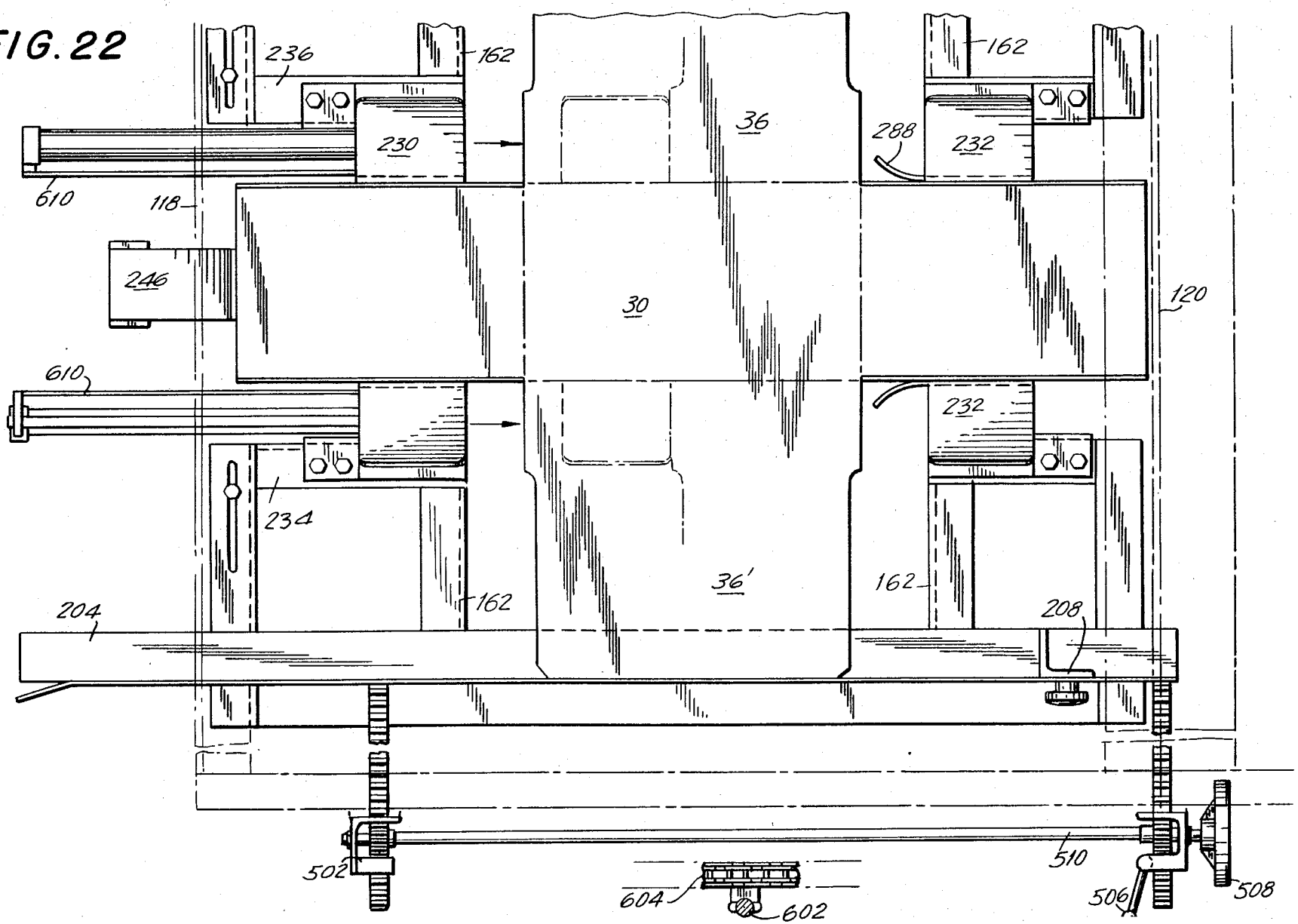
FIG. 22 is a sectional view taken along line 22—22 of FIG. 20 showing a top plan of the first folding section.
Figure 23:
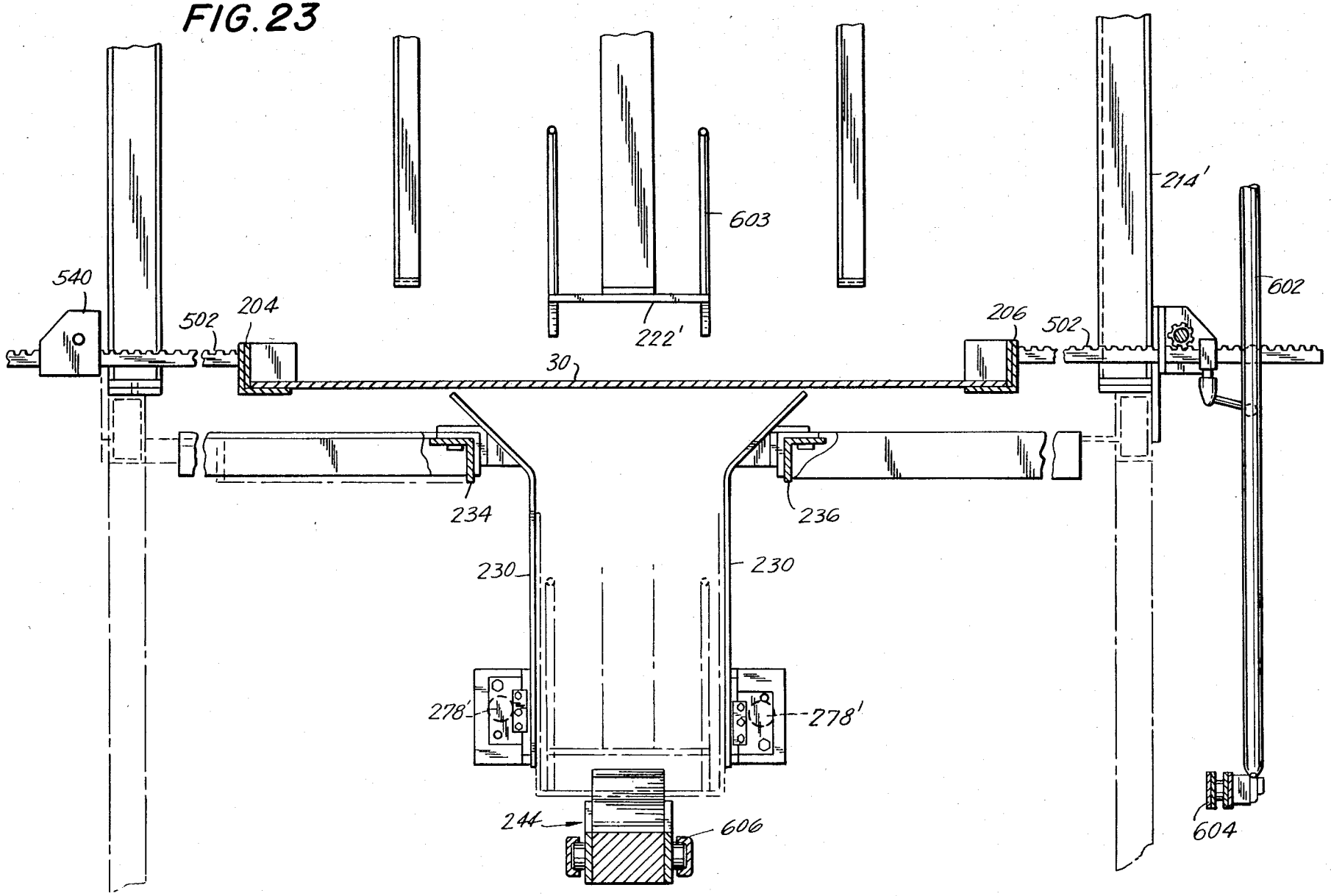
FIG. 23 is a sectional view taken along line 23—23 of FIG. 20 showing a front view of the first folding station.
Figure 24:
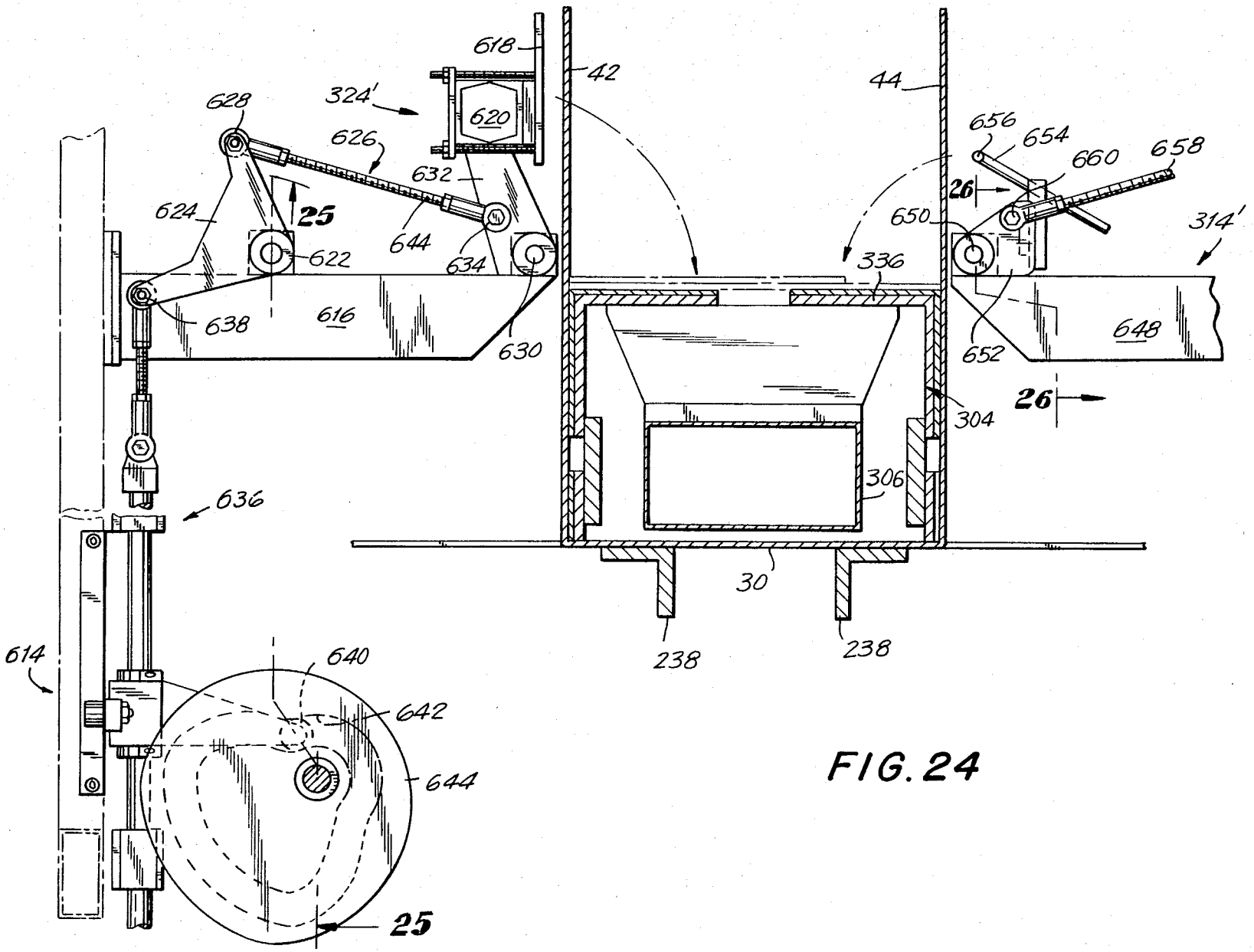
FIG. 24 is a sectional view taken along line 24—24 of FIG. 18 showing a front view of the mechanical flap folder assemblies in the second folding station.

The first folding step is accomplished by a first ram assembly 212 (FIG. 4). A superstructure 214 of ram assembly 212 is affixed to upper longitudinal frame members 106 and 108. A ram casting box 216 is mounted at the center of superstructure 214 and contains an air cylinder 218 and two guide rods 220 which are connected to and drive ram plate 222 vertically. The ram plate 222 (FIG. 5) is an elongated member with diverging side plates 224 attached thereto. When the photocell 210 detects a carton blank in the proper position, a series of relays activate a ram circuit that causes the ram plate 222 to descend, driving the carton blank 30 down from the upper guide rails 204 and 206 to lower guide rails 226 and 228. Lower guide rails 226 and 228 extend throughout the entire length of the frame 100 and are supported by and affixed to lower transverse frame members 110, 112, 114 and 116. Auxiliary guide plates 229 are mounted on lower guide rail 226 and 228. As the ram plate 222 descends, the flaps 40, 40', 42, 42', 44, 44', 46 and 46' are erected to a vertical position as a result of contacting two pairs of upright plates 230 and 232 (FIGS. 4 and 5) attached to a pair of plate mounting bars 234 and 236. The plate mounting bars 234 and 236 are adjustably affixed to idler shafts 514 and upper transverse frame members 118 and 120. Center blank guide rods 284 for supporting the blank 30 before the ram plate 222 descends are also mounted on plate mounting bars 234 and 236 through mount member 286. In an alternative embodiment, rods 284 are eliminated and plate mounting bars 234 and 236 are truncated (FIG. 22) in the area where end walls 36 and 36' travel downward. This is done so that when apparatus 20 operates at higher speeds, end walls 36 and 36' travel downward without obstruction from rods 284 or plate mounting bars 234 and 236. Plate mounting bars 234 and 236 are further supported by transverse frame mounts 162.

Figure 7:
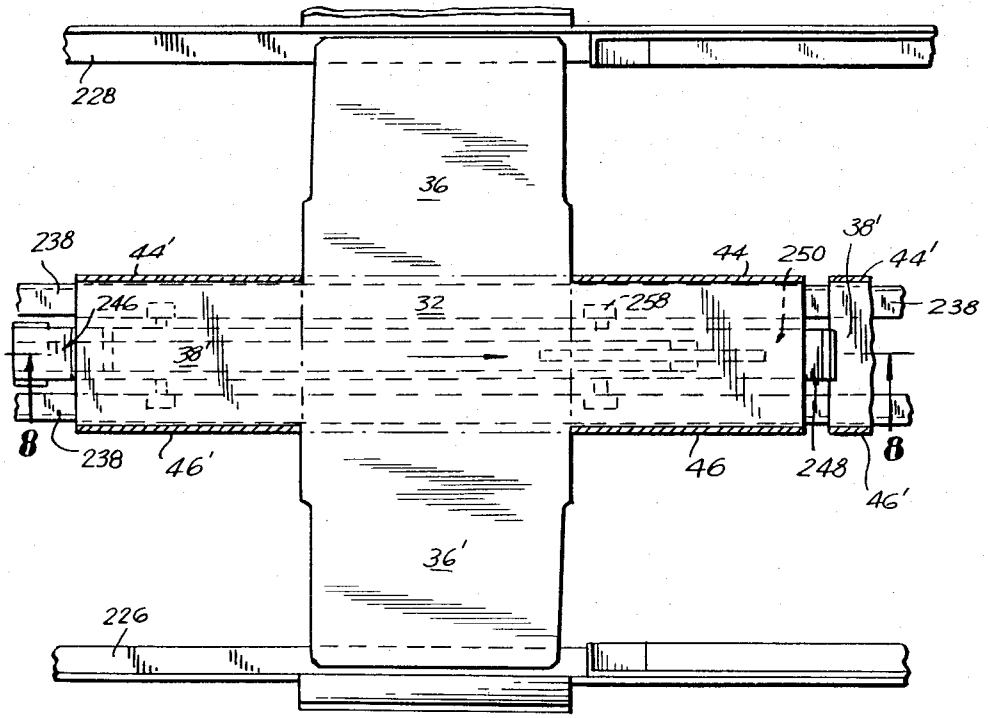
FIG. 7 is a sectional view taken along line 7—7 in FIG. 1 showing a top plan of the lower portion of the first folding station.

The bottom wall 32 and side walls 38 and 38' of the carton blank 30 are now lying horizontally on support tracks 238 (FIG. 7) and end walls 36 and 36' are also horizontal, supported by lower guide rails 226 and 228. The folding operation of the first folding station is now complete, with the partially folded carton 30 shown in plan view in FIG. 7.

Figure 8:
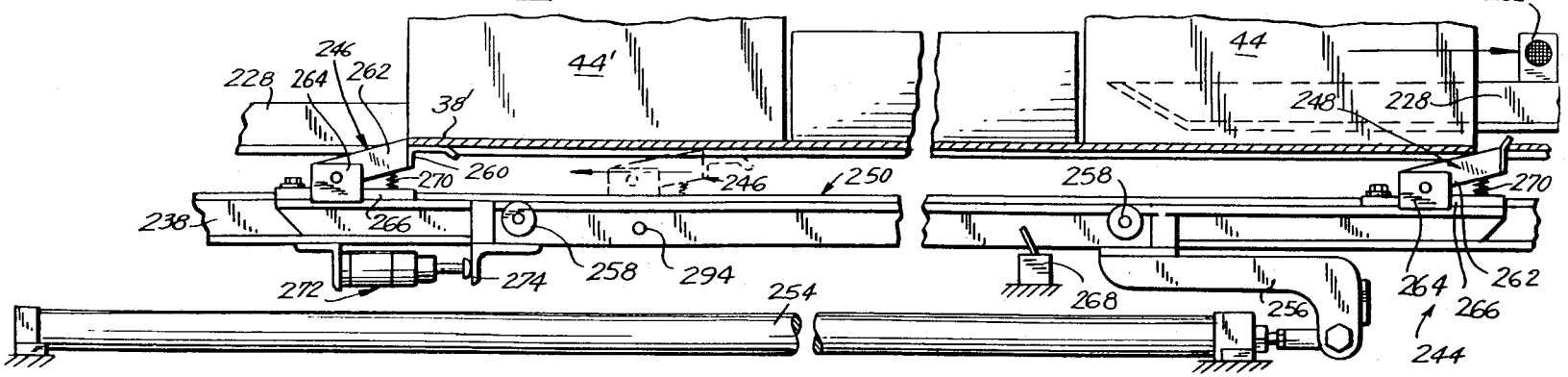
FIG. 8 is a sectional view taken along line 8—8 in FIG. 7 showing the pusher assemblies in the first and second folding stations.

The complete descent of the ram plate 222 triggers a pair of switches 240 and 242 (FIG. 4), located on the top of the ram superstructure 214. The first switch 240 returns the ram assembly 212 back to its original position while the second switch 242 activates an advancing means 244 (FIG. 8) for delivering the carton blank 30 to the second folding station 300 and at the same time delivering any preceding blank 30 to the third folding station 400.

The advancing means 244 comprises a first pusher mechanism 246 and a second pusher mechanism 248, both fixedly mounted onto a carriage member 250, which extends parallel to and between support tracks 238. The distance between the first and second pusher mechanisms 246 and 248 is approximately the length of carton blank 30. Air cylinder 254 is mounted to carriage member 250 through cylinder end mount 256. When air cylinder 254 is activated by switch 242, the carriage assembly 250 is caused to move horizontally toward folding stations 300 and 400 along support tracks 238 and rollers 258. Side wall 38' of the carton blank 30 rests on pusher lip 260 of the first pusher mechanism 246. The carton blank 30 is thus pushed from behind to the second folding station 300 by a pusher block 262 which is pivotally mounted upon pusher base 264 which in turn is mounted on carriage member 250 through carriage mount 266. Similarly, side wall 38' of a second carton blank 30, which has previously been advanced to the second folding station 300, rests on pusher lip 260 of the second pusher mechanism 248 and is pushed from behind to the third folding station 400. Thus, the carriage member 250 advances so that the pusher assemblies 246 and 248 move in tandem to deliver simultaneously carton blanks to the second and third folding stations 300 and 400.

When the carriage member 250 advances to its forwardmost position, a limit switch 476 (FIG. 16) initiates retraction of the carriage member 250 to its starting position. Pusher blocks 262 are lowered as allowed by the pivotal connection between pusher blocks and bases 260 and 262 and compression springs 270 so that the carton blanks 30 are not disturbed as the pusher mechanisms 246 and 248 retract. Finally, shock absorber 272 receives the carriage member 250 back into the starting position of advancing means 244 when stop member 274 contacts shock absorber 272.

As the carriage member 250 advances forward, a flap activator switch 276 (FIG. 6) triggers a pair of air cylinders 278 which cause a pair flap retainer arms 280 (FIG. 5) to retract inwardly to maintain flaps 40', 42', 44' and 46' in a vertical position as the carton blank 30 passes from the first folding station 200 to the second folding station 300. Flap retainer arms 280 are attached to upright plates 230 by pivot blocks 282 and mount plates 292. Guide fins 288 and guide rods 290 affixed to upright plates 232 serve a similar purpose in maintaining the carton 30 in its partially folded configuration between the first and second folding stations 200 and 300. As the blank 30 reaches the second folding station 300, the flap retainer arms 280 will return to their initial position out of the way of the next descending carton blank 30 being driven down by the first ram assembly 212.

In an alternative embodiment, flap retainer arms 280 are eliminated. Instead, upright plates 230 move forward with the box (FIG. 22) as the box advances between the first and second folding stations 200 and 300 to maintain flaps 40', 42', 44' and 46' in a vertical position. In this alternative embodiment, therefore, upright plates 230 are not affixed to plate mounting bars 234 and 236 but are attached to and moved by air cylinders 278'. Whether flap retainer arms 280 or upright plates 230 are used depends on the size of box being manufactured.

Figure 9:
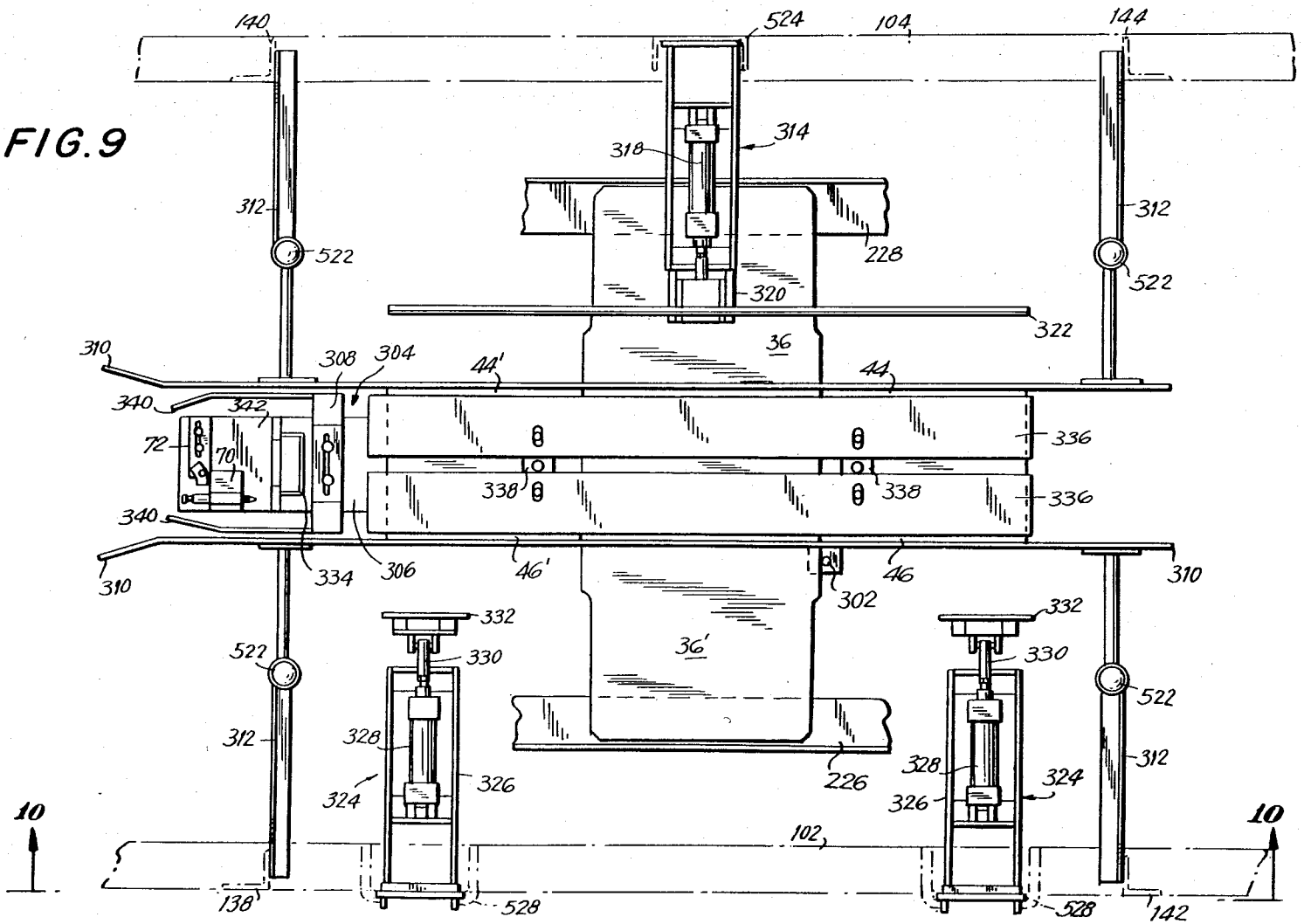
FIG. 9 is a sectional view taken along line 9—9 in FIG. 1 showing a top plan of the second folding station.
Figure 10:
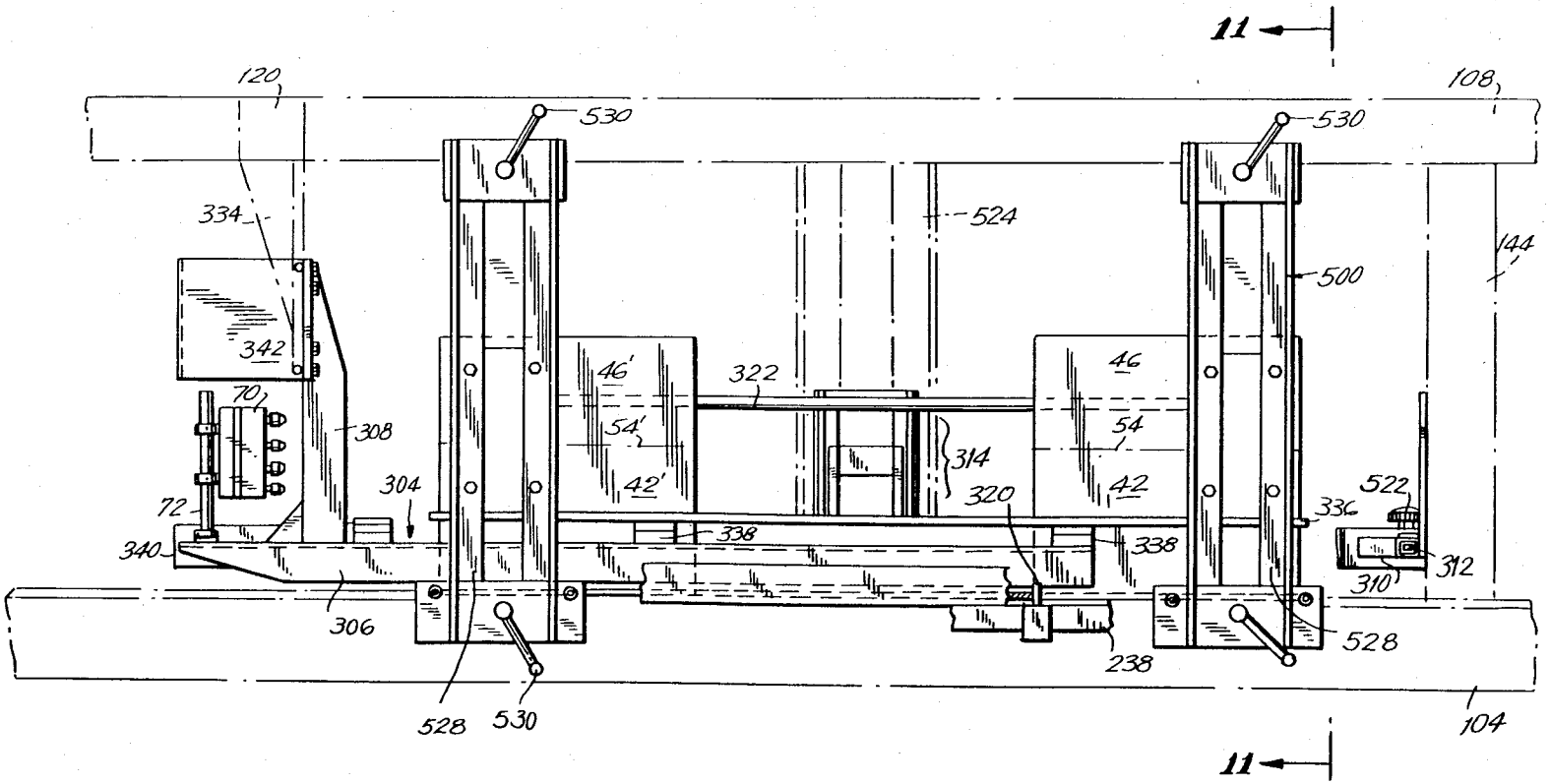
FIG. 10 is a sectional view taken along line 10—10 in FIG. 9 showing a side view of the second folding station.

As the partially erected carbon blank 30 moves from the first folding station 200 to the second folding station 300, a second sensing means, such as photocell 202 mounted on lower guide rail 228 (FIG. 8), reads that the side flaps are in a vertical position and activates the glue gun 70 which sprays glue on the inner surfaces of the now vertical upper-left flaps 46 and 46' (FIG. 9). The glue gun 70 may be a commercially available device such as a Nordsen Model A which is capable of spraying hot melt glue from a glue reservoir (not shown).

At the second folding station 300 (FIGS. 9–12), an air-actuated vertical stop rod 302 (FIG. 9) is attached to support track 238 and abuts the edge of end wall 36' stopping the carton blank 30 so that it is correctly aligned in the second folding station 300. Stop rod 302 was activated when bar 294 on carriage assembly 250 triggered switch 268 (FIG. 8) to an up position prior to the arrival of the carton blank 30 in the second folding station 300. When the folding steps of the second folding station 300 are complete, the stop rod 302 retracts so that the blank can be moved to the third folding station 400.

The blank 30 has been fed into the second folding station 300 underneath a compression mandrel assembly 304 (FIGS. 9 and 10), comprising an elongated rectangular mandrel member 306 and a right angle portion 308 affixed to transverse frame member 120 through attachment plate 334. Mandrel member 306 extends over the length of side walls 38 and 38' and bottom wall 32 of carton blank 30. Mandrel plates 336 are mounted to mandrel member 306 through plate mounts 338. Glue gun 70 is also mounted to mandrel member 306 by bracket 72. A glue shield 342 is mounted behind right angle mandrel portion 308 and through mandrel attachment plate 334.

The now vertical flaps 40, 40', 42, 42', 44, 44', 46, and 46' are supported between the mandrel member 306 and a set of adjustable outer guide rails 310 and inner guides 340. The adjustable outer guide rails 310 are attached to frame members 102 and 104 by adjustable support rods 312. Inner guides 340 are attached to mandrel member 306. The side walls 38 and 38' and bottom wall 32 of the blank 30 are supported from below by support tracks 238.

Figure 11:
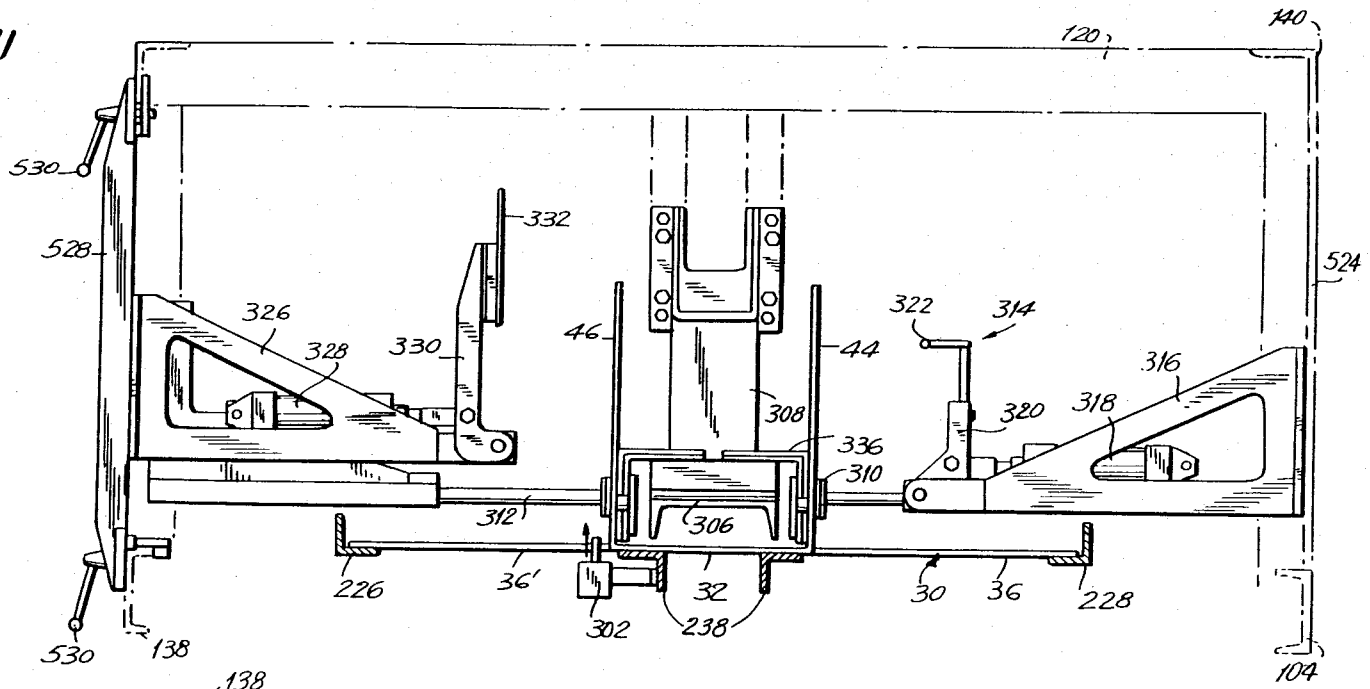
FIG. 11 is a sectional view taken along line 11—11 in FIG. 10 showing a front view of the second folding station before the flap folding operation.
Figure 12:
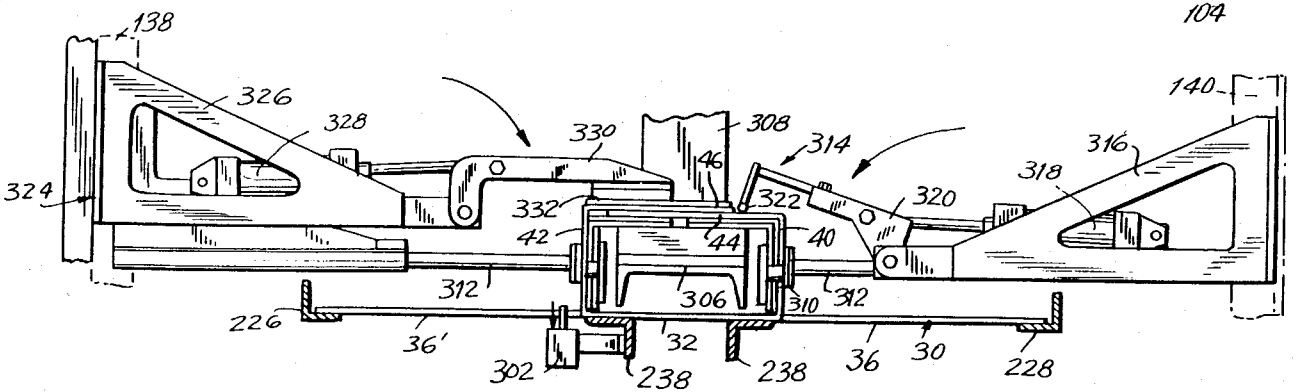
FIG. 12 is the same sectional view as shown in FIG. 11 and shows a front view of the second folding station after the flap folding operation.
Figure 13:
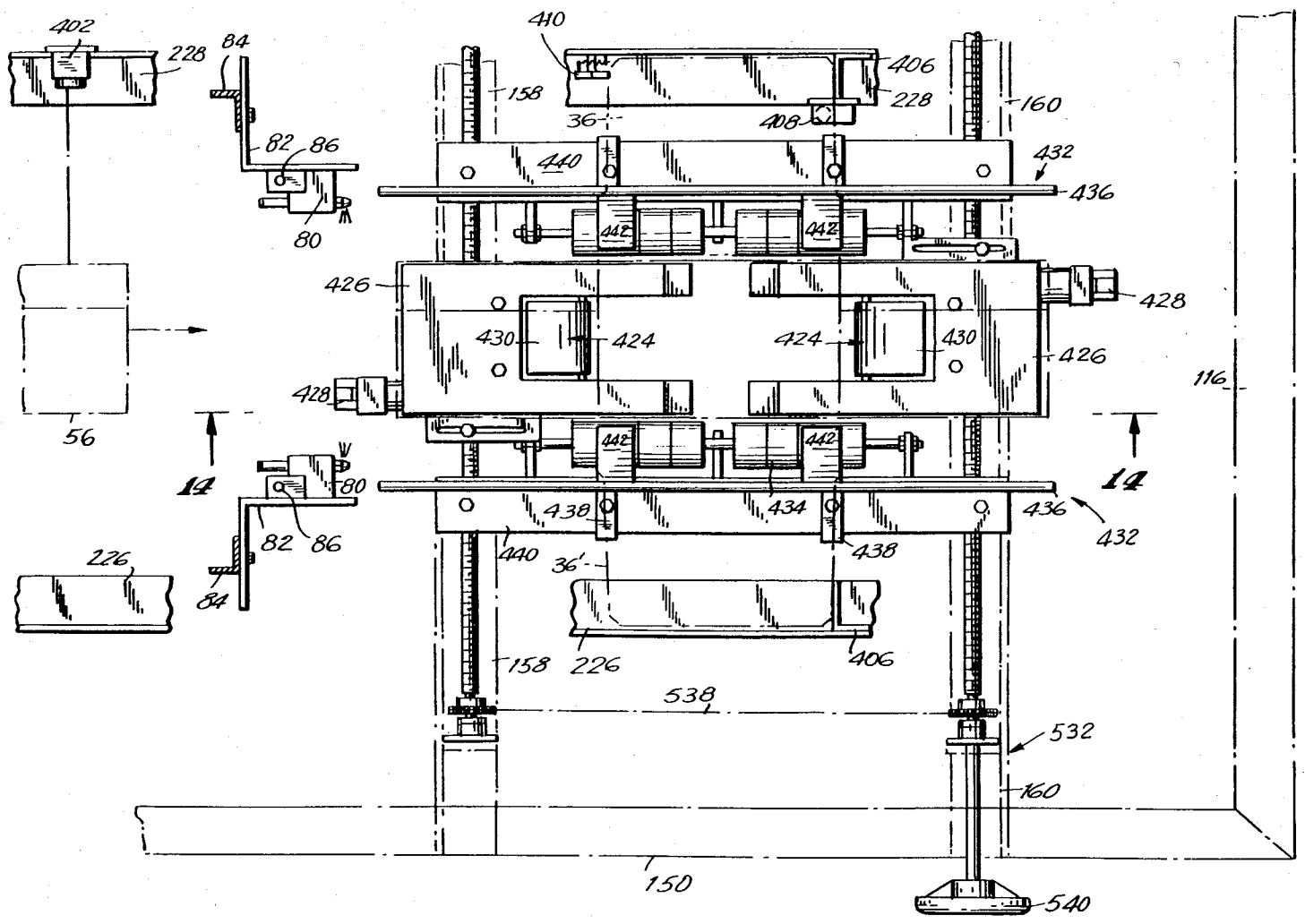
FIG. 13 is a sectional view taken along line 13—13 in FIG. 1 showing a top plan of the third folding station.
Figure 14:
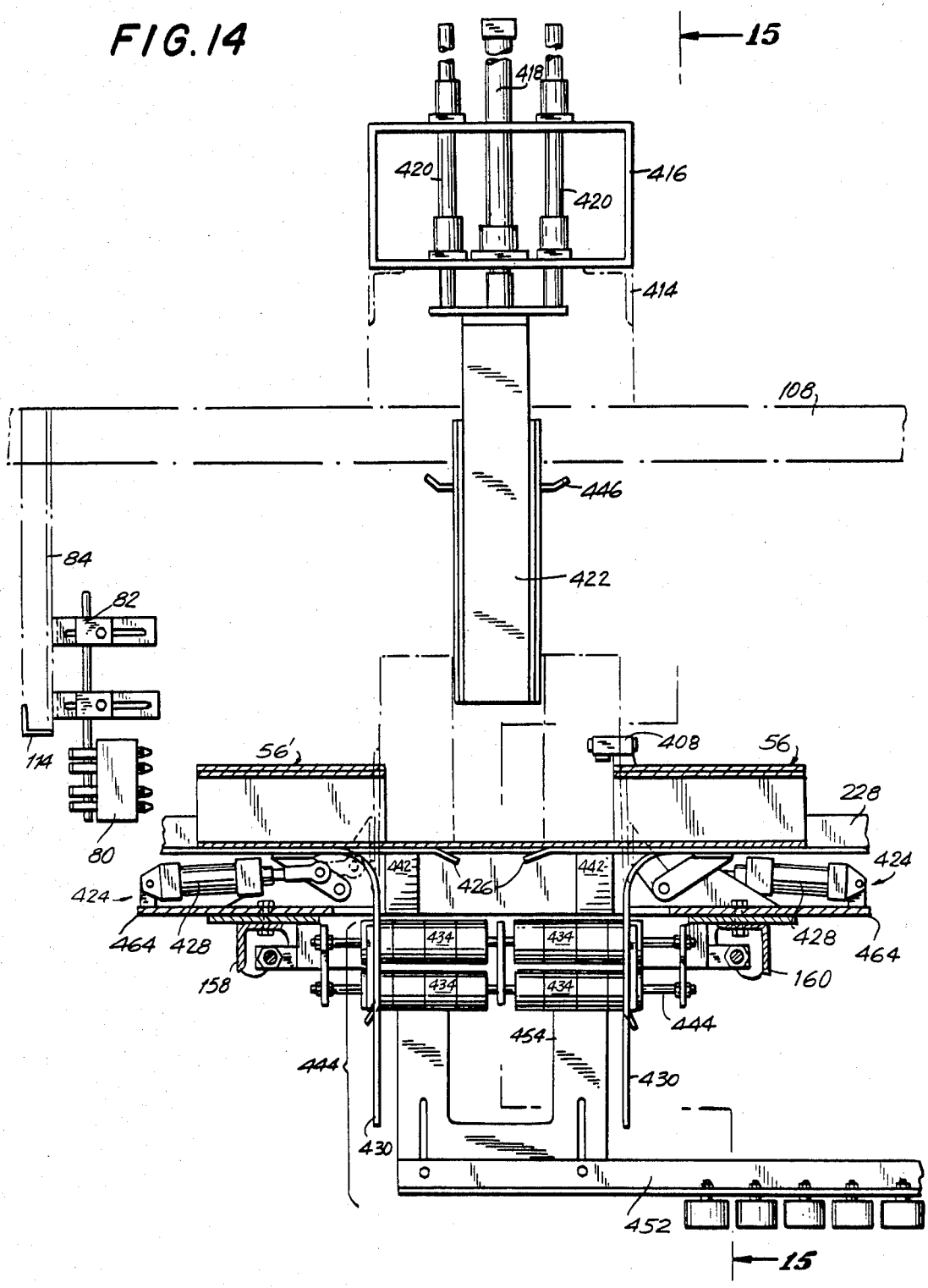
FIG. 14 is a sectional view taken along line 14—14 of FIG. 13 showing a side view of the third folding station.

The partially folded carton blank 30 and apparatus 20 are shown in FIG. 11 before the folding operations of the second folding station 300. A right flap folder 314 is attached to frame 100 by bars 524 attached between lower and upper longitudinal frame members 104 and 108. Right flap folder 314 comprises an angle brace 316 (FIG. 11) housing an air cylinder 318, the air cylinder 318 being attached to and controlling a pivotally mounted arm 320 for oscillatory motion in a vertical plane. Attached to arm 320 is a horizontal rod 322 which contacts and folds the upper-right flaps 44 and 44' into a horizontal position around the elongated rectangular member 306 of the compression mandrel 304. A pair of left flap folder assemblies 324 (FIG. 9) then folds the previously glued upper-left flaps 46 and 46' down upon upper-right flaps 44 and 44' thus sealing these flaps together to form two open-ended rectangular tubes 56 and 56'. Each of the two left flap folder assemblies 324 is adjustably affixed to frame 100 by bars 528 attached between lower and upper longitudinal frame members 102 and 106. Left flap folder assemblies 324 comprise bracing angles 326 which house air cylinders 328, the air cylinders 328 being attached to and controlling pivotally mounted arms 330 for oscillatory motion in a vertical plane. A rectangular compression plate 332 is attached to each arm 330. FIG. 12 shows the positions of the right and left flap folder assemblies 314 and 324 in their extended positions at the completion of their folding operations.

After completion of the folding operations of the second folding station 300, advancing means 244 drives the blank 30 to the third folding station 400 as explained above. Thus, as the first pusher mechanism 246 advances a blank from the first folding station 200 into the second folding station 300, the second pusher mechanism 248 advances a second blank forward from the second folding station 300 into the third folding station 400.

The third folding station 400 is shown in FIGS. 13–17. The partially folded carton blank 30 passes a third sensing means, such as photocell 402 (FIG. 13) located on lower guide rail 228 between the second and third folding stations 300 and 400, thereby triggering a second pair of glue guns 80, similar to the first glue gun 70. Glue guns 80 are attached to transverse frame member 122 through rods 86, brackets 82, and frame mounts 84. The second pair of glue guns 80 applied glue to the outer portion of lower-right and lower-left flap surfaces 40, 40', 42 and 42', now part of open-ended rectangular tubes 56 and 56', for the final combination with the end walls 36 and 36' to create the completed carton 60.

The blank 30 is driven by the second pusher mechanism 248 up against a pair of upstanding stop members 406. There, a fourth sensing means, such as photocell 408 (FIG. 13), detects the blank 30 in its forwardmost position. Photocell 408 triggers the positioning of a back stop 410 located on lower guide rail 228 to prevent the blank 30 from shifting rearwardly when the blank 30 has been pushed to its full forward position.

Photocell 408 also activates a second ram assembly 412, similar in construction to the first ram assembly 212. A superstructure 414 of the second ram assembly 412 is affixed to upper longitudinal frame members 106 and 108. At the center of superstructure 414 is mounted a ram casting box 416 which contains an air cylinder 418 and two guide rods 420 which are connected to a ram compression column 422. The ram compression column 422 descends and contacts bottom wall 32, while at the same time a pair of tube lifter arms 426 of tube lifter arm assemblies 424 swing to a vertical position thereby erecting the rectangular tubes 56 and 56' to a position normal to bottom wall 32. The tube lifter arm assemblies 424 comprise tube lifter arms 426 and a pair of curved auxiliary plates 430. Tube lifter arms 426 are actuated by air cylinders 428 which are affixed to transverse frame members 158 and 160 through shelves 464. Curved auxiliary guide plates 430, also affixed to shelves 464, keep the rectangular tubes 56 and 56' in a vertical position as blank 30 descends during the final folding operations.

As the ram compression column 422 continues to descend, end walls 36 and 36', which have been in a horizontal position throughout the folding operations, are now caused to stand in a vertical position as a result of contacting a pair of fixed side plate members 432 (FIG. 15) and roller members 434. Each side plate member 432 comprises an elongated rod 436 attached by a right angle support bracket 438 to longitudinal support beams 440 which are adjustably mounted onto transverse frame members 158 and 160. Attached to each elongated rod 436 is an angular plate 442 for guiding end walls 36 and 36' into a final vertical position by interaction between the ram compression column 422 and roller members 434. The roller members 434 rotate about rods 444. Rods 444 extend through mounts 466 which are in turn attached to longitudinal support beams 440.

Figure 15:
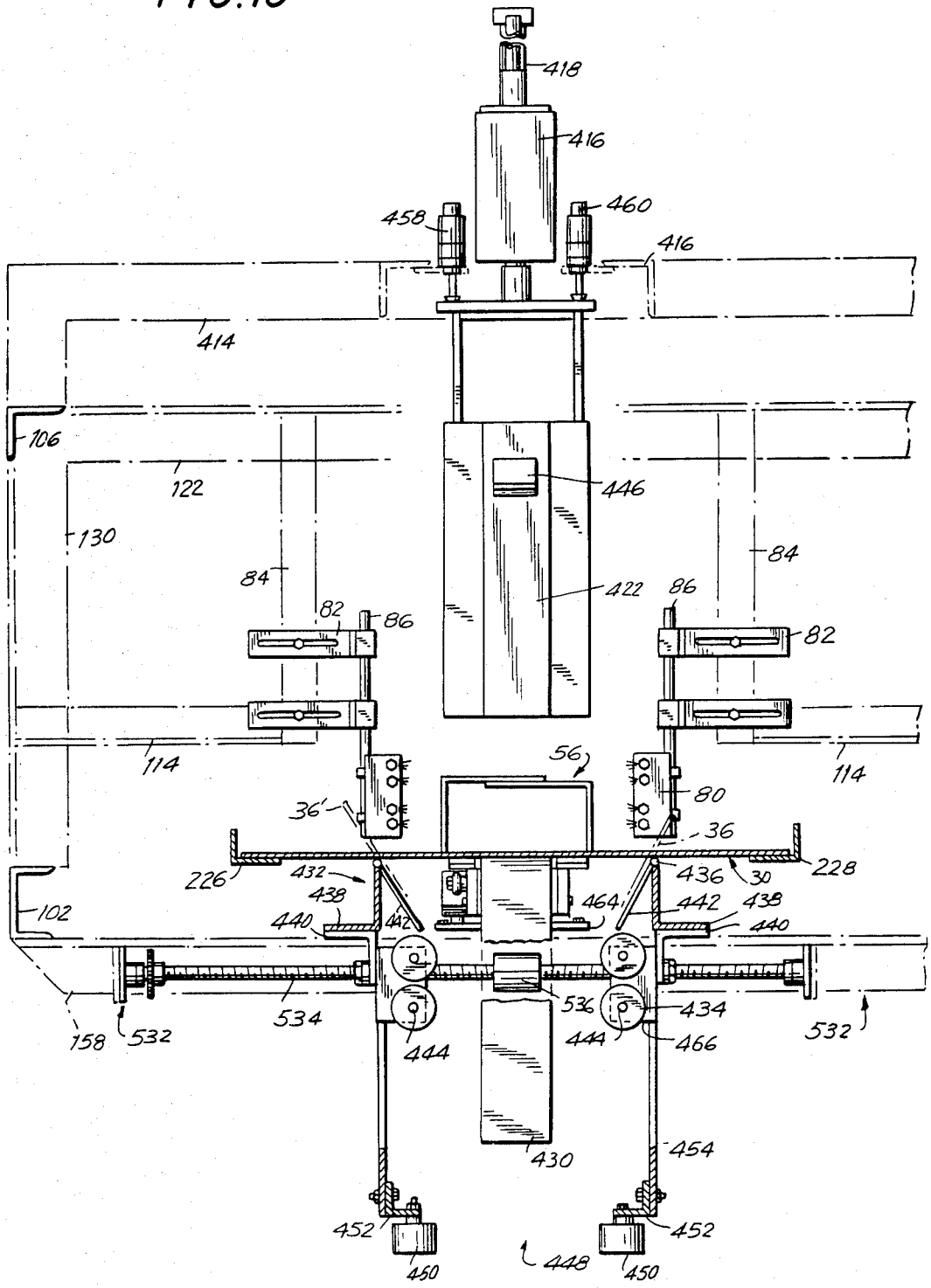
FIG. 15 is a sectional view taken along line 15—15 in FIG. 14 showing a front view of the third folding station.
Figures 16, 17:
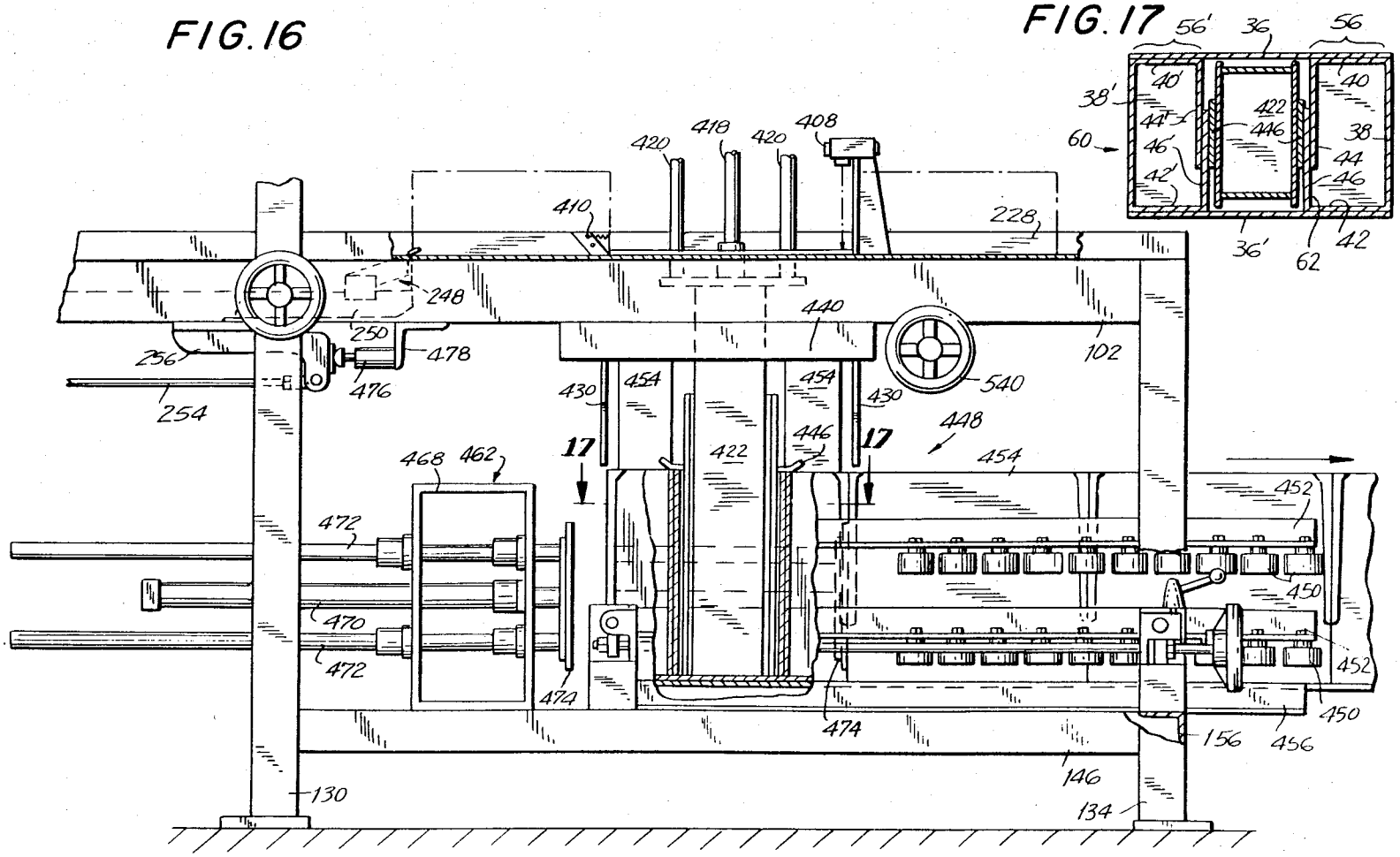
FIG. 16 is a sectional view taken along line 16—16 in FIG. 1 showing the side view of the compression area of the third folding station.
FIG. 17 is a sectional view taken along line 17—17 in FIG. 16 showing a top plan of the completed box in the third folding station.
Figure 18:
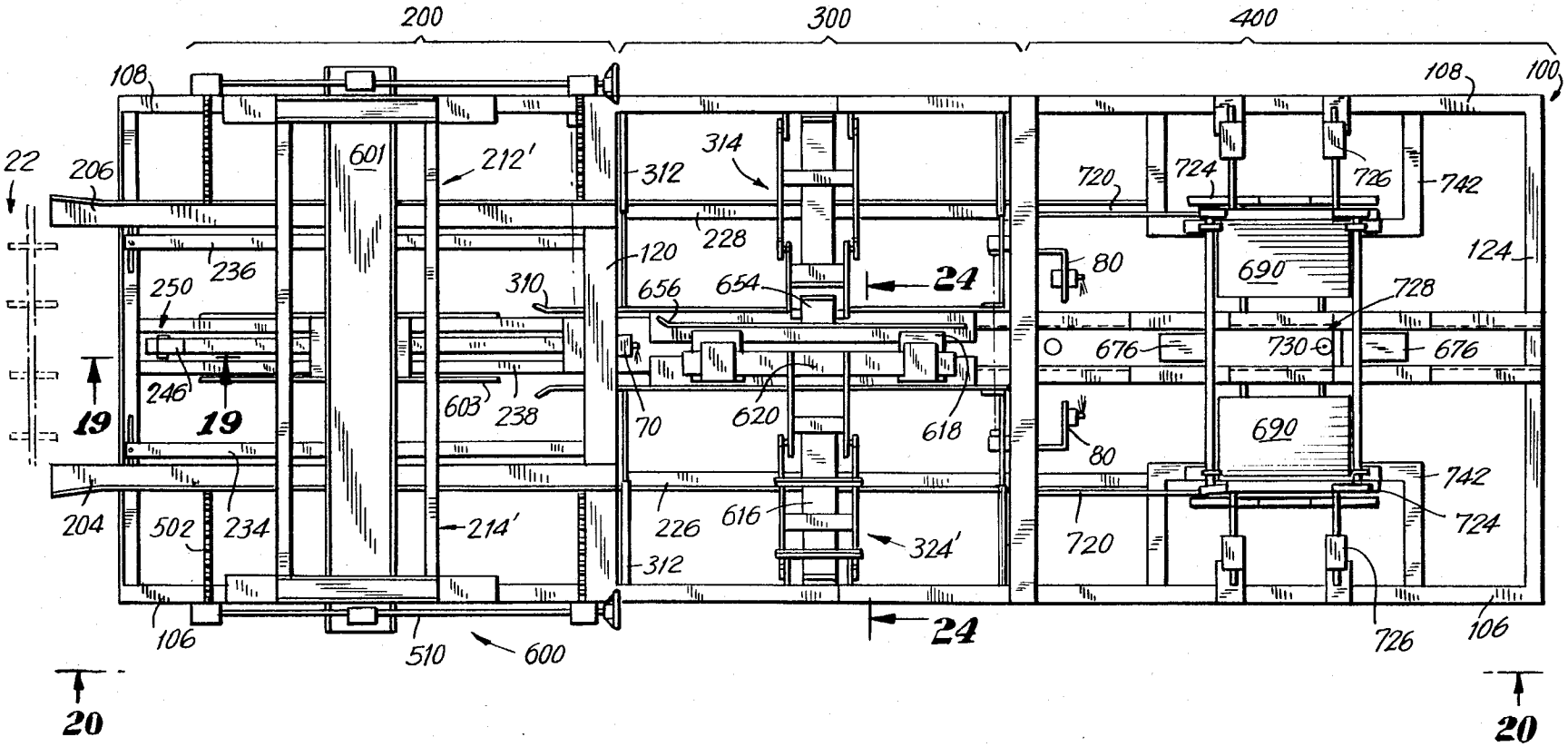
FIG. 18 is an overall top plan of an alternative embodiment.

As shown in FIGS. 16 and 17, the ram compression column 422 is designed to fit between the space created between the now vertical rectangular tubes 56 and 56' which include interior partitions 62 of the finished box 60. Two pusher bars 446 affixed to the ram compression column 422 are positioned to exert additional downward force to interior partitions 62 into a compression area 448. The compression area 448 comprises a series of rubber rollers 450 affixed to roller mount rails 452 and a slide tray 456. Roller mount rails 452 are affixed to side plates 454 which are in turn mounted on longitudinal support beams 440 (FIG. 15). The rubber rollers 450 hold the end walls 36 and 36' onto the previously glued lower flaps 40, 40', 42 and 42' of open-ended rectangular tubes 56 and 56' until the glue is set.

At the bottom of the stroke of ram column 422, a switch 458 (FIG. 15) located on top of the ram casting box 416 is activated and ram compression column 422 returns to its initial position. A second switch 460 also located on the ram casting box 416 activates a discharge ram assembly 462 (FIG. 16). Discharge ram assembly 462 is mounted between transverse frame members 154 and 158 and comprises ram casting box 468, air cylinder 470, guide rods 472, and ejector plate 474. The discharge ram assembly 462 pushes the completed box 60 (shown in cross-section in FIG. 17) along the slide tray 456 and against rubber rollers 450 out of the way of a next descending completed box. When the second completed box 60 is pushed forward by the discharge ram 462, the second completed box 60 in turn pushes the first completed box 60 further along the slide tray.

It will be understood from the preceding description that various functions of the apparatus must be performed in a timed sequence. It is conventional to provide, for example, a series of cam operated switches to provide timed control signals to actuate valves or switches in several pneumatic and electrical systems to control the actuation of the various air cylinders and glue heads. As such control systems and circuits are well known, it is deemed unnecessary to describe them in detail.

While the description of apparatus 20 so far has been primarily in terms of pneumatic operation of the various driving parts, apparatus 20 may readily be adapted for mechanical or other driving means. An alternative embodiment of apparatus 20, shown in FIGS. 18–32, uses a combination of mechanical and pneumatic drive systems.

In the alternative embodiment, first ram assembly 212' (FIGS. 18 and 20) in the first folding station 200 is operated by mechanical drive system 600. First ram assembly 212' (FIGS. 18 and 20) comprises ram superstructure 214', guide rods 220', ram plate 222', horizontal bar 601, rectangular frame 603 and angle supports 605. Angle supports 605 affixed superstructure 214' to upper longitudinal frame members 106 and 108. Rods 602 of mechanical drive system 600 connect first ram assembly 212' at horizontal bar 601 to triangular chain and sprocket driving means 604. Movement of chain and sprocket driving means 604 causes first ram assembly 212' to move up and down. The triangular shape of chain and sprocket driving means 604 is used to gain a dwell time while first ram assembly 212' is in the up position so that a new blank can be inserted into the first folding station 200.

Figures 19, 20:
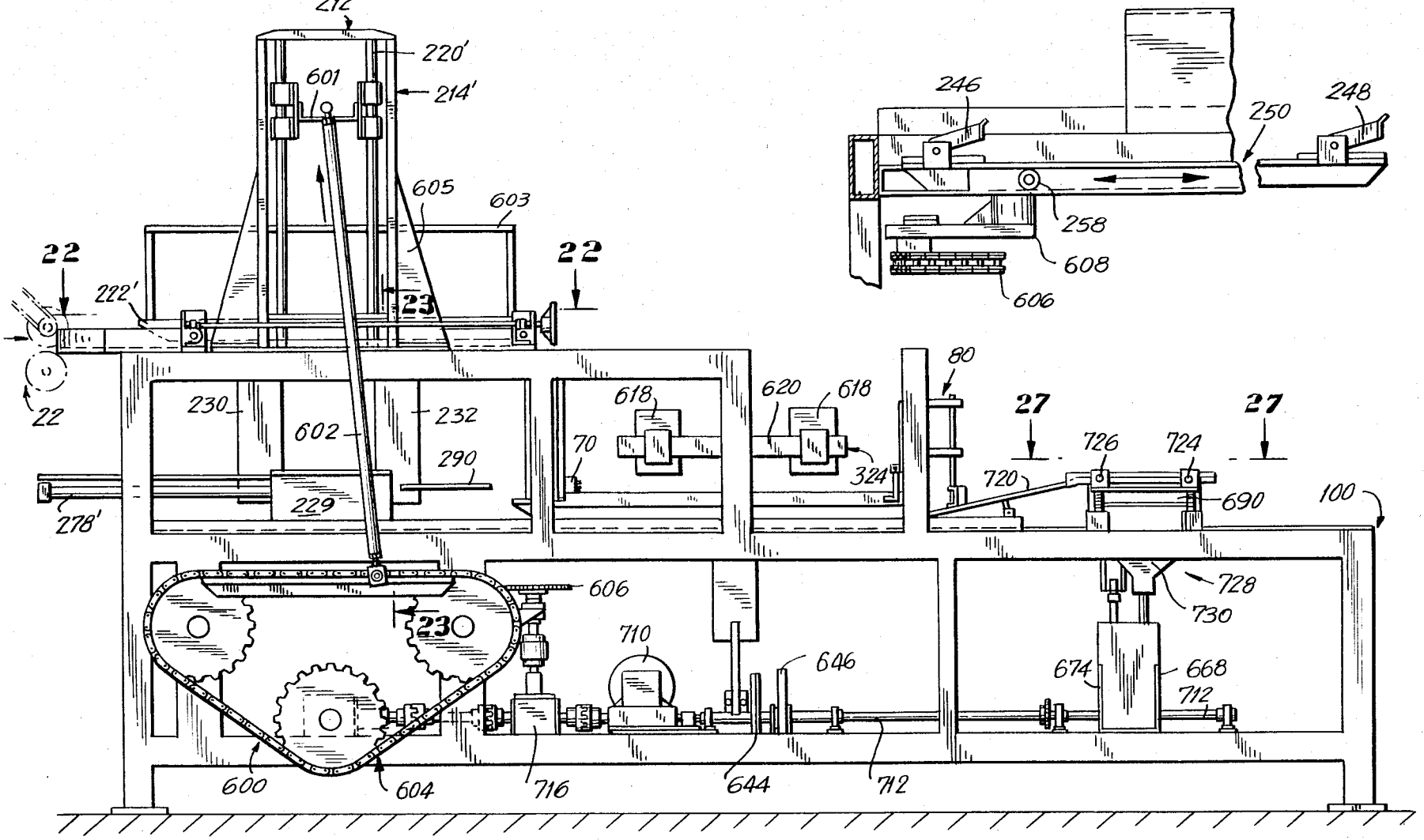
FIG. 19 is a sectional view taken along line 19—19 in FIG. 18 showing a mechanical drive means for the pusher assemblies.
FIG. 20 is a sectional view taken along line 20—20 in FIG. 18 showing a side view of the first, second and third folding stations.

The advancing means 244 is driven mechanically as shown in FIG. 19, with chain and sprocket driving means 606 connected to carriage member 250 through arm 608.

Figure 21:
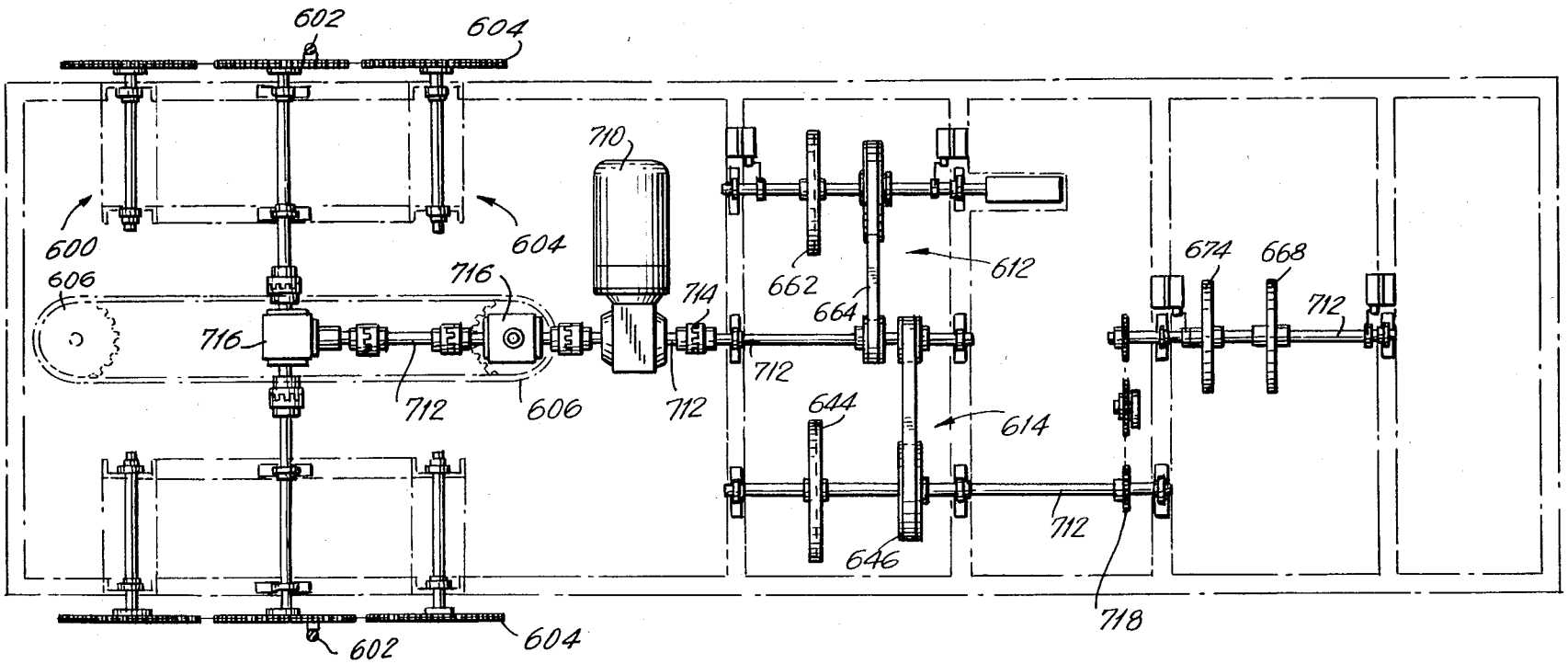
FIG. 21 is a top plan of a mechanical drive system.

In the second folding station 300, right and left flap folder assemblies 314' and 324' are mechanically operated by cam-operated drive systems 612 and 614, respectively (FIG. 21). In the alternative embodiment, left flap folder assemblies 324' have been combined to sit on one frame mount 616 with compression pads 618 connected through horizontal bar 620. In the earlier described embodiment, left flap folder assembly 324 comprised two separately mounted and operated folding means. The mechanical embodiments of the left and right flap folder assemblies 314' and 324' are shown in detail in FIG. 24.

Left flap folder assembly 324' comprises fixed pivot rod 622, set on frame mount 616, to which activator plates 624 are mounted at each end. Arms 626 are connected to actuator plates 624 at pivot connectors 628. A second fixed pivot rod 630 is set on frame mount 616. At each end of second pivot rod 630 are connector plates 632. Arms 626 are affixed to connector plates 632 at pivot connectors 634. Horizontal bar 620 is affixed across connector plates 632. Rod 636 of mechanical drive assembly 614 is connected at pivot connector 638. Cam follower 640 is mounted on rod 636 and follows groove 642 of face cam 644 driven by belt 646 in order to drive compression pads 618 to the up or down positions.

Right flap folder assembly 314' is mounted to frame 100 through frame mount 648. Pivot rod 650 is set on frame mount 648. At eight end of pivot rod 650 is a connector plate 652. Horizontal rod mount 654 is affixed between connector plates 652 and supports horizontal rod 656 used for folding down upper-right flaps 44 and 44'. Arms 658, connected to connector plate 652 at pivot 660, are operated in a similar manner to arms 626 of left flap folder assembly 324' with ultimate operation by mechanical drive assembly 612 comprising face cam 662 and belt 664.

Second ram assembly 412 in the third folding station 400 has been eliminated in the alternative embodiment. Instead, rectangular tubes 56 and 56' are folded into a vertical position by tube lifter arm assemblies 424' (FIGS. 27, 28 and 29) activated by cam-operated drive system 668.

Figure 29:
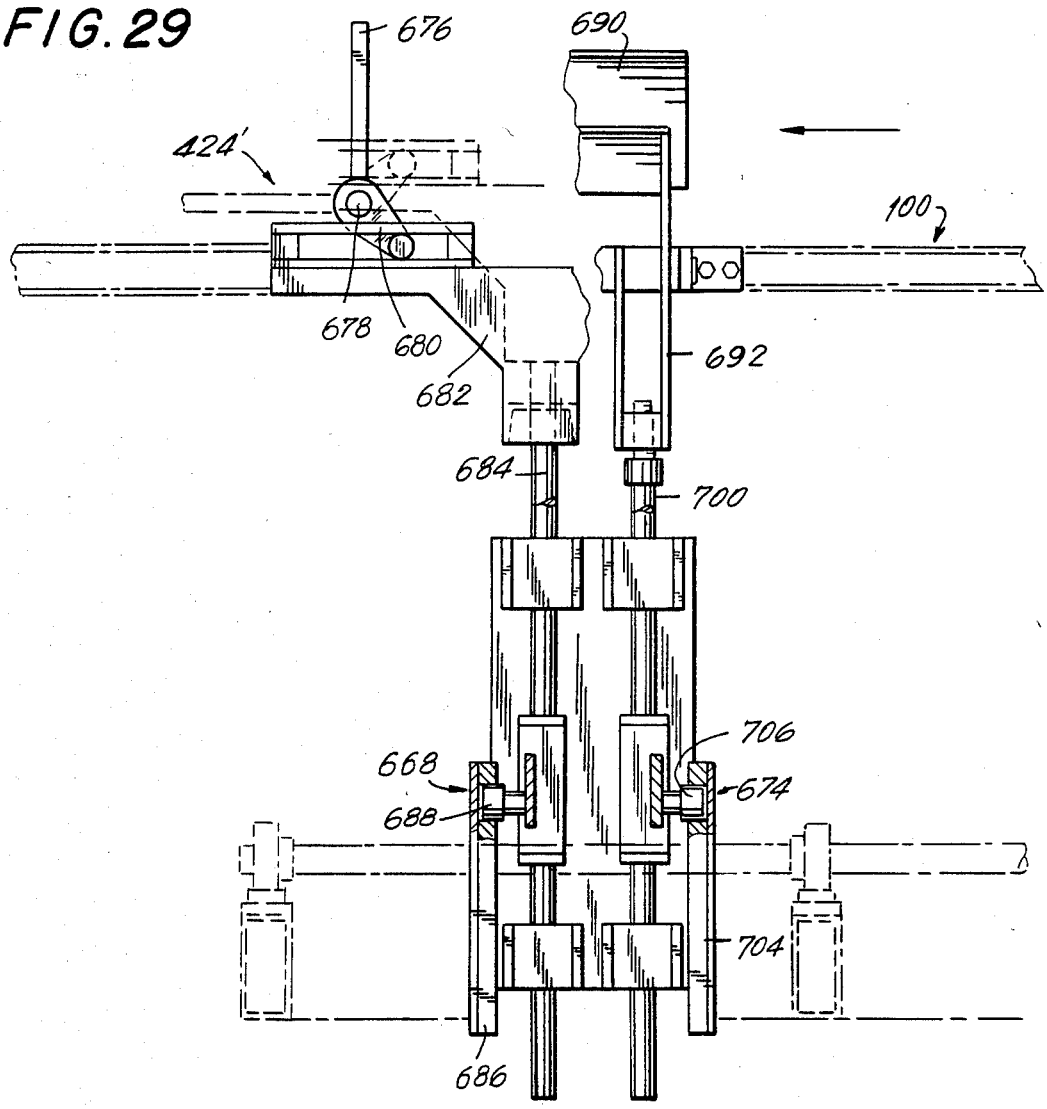
FIG. 29 is a sectional view taken along line 29—29 of FIG. 28 showing a side view of the rectangular tube folder and end wall folder assemblies in the third folding station.
Figure 30:
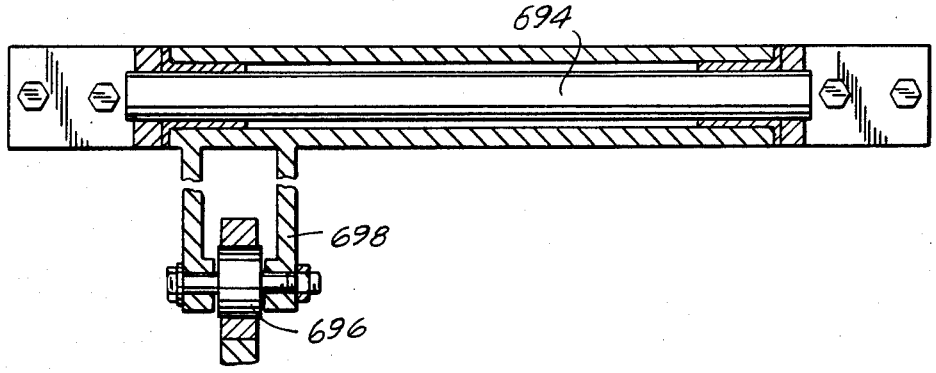
FIG. 30 is a sectional view taken along line 30—30 of FIG. 28 showing a side view of the pivot and roller of the end wall folder assembly in the third folding station.

After tube lifter arm assemblies 424' have erected rectangular tubes 56 and 56' to a vertical position, end wall folder assemblies 670 complete the box by reacting end walls 36 and 36', finally sealing the end walls 36 and 36' to rectangular tubes 56 and 56' to obtain a secure bonding of glue. End wall folder assemblies 670 are actuated by cam-operated drive system 674 (FIG. 29). Thus, there is no downward movement of a ram. Accordingly, there is no compression area 448 or discharge ram assembly 462 as in the first described embodiment of the invention. Rather, the completed carton 60 is discharged by the action of the next partially folded carton 30 advancing from the second folding station 300 into the third folding station 400.

Tube lifter arm assemblies 424', mounted to lower longitudinal frame member 102 through frame mount 742, comprise tube lifter arms 676 mounted at the center of fixed pivot rods 678. Connector plates 680 are affixed at either end of fixed pivot rods 678 and to tube folder actuator 682 which in turn is affixed to cam-operated drive mechanism 668. Drive system 668 comprises rod 684, to which tube folder actuator plate 682 is connected, face cam 686 and cam follower 688. As shown in FIG. 29, when rod 684 pushes tube folder actuator 682 up, tube lifter arms 676 are in the down position.

End walls folder assemblies 670, mounted frame mounts 672, comprise compression pads 690 affixed to actuator plates 692. Actuator plates 692 are affixed to fixed pivot rods 694. Rollers 696 link actuator plates 692 to bridge 698 through which rollers 696 can travel. When rod 700 of drive assembly 674 moves up, rollers 696 are forced to travel along bridge 698 causing compression pads 690 to a vertical position to fold end walls 36 and 36'. Drive assembly 674 also comprises cam and shaft connecting bar 702, face cam 704, cam follower 706 and groove 708.

FIG. 32 shows the sequence of carton 30 through the alternative embodiment and can be compared with FIG. 3 to show the elimination in the alternative embodiment of the downward movement of carton 30 the third folding station 400.

The alternative embodiment thus provides for a mainly mechanical drive system, driven by motor 710 (FIG. 21) wherein first ram assembly 212', right and left flap folder assemblies 314' and 324', tube lifter arm assemblies 424' and end wall folder assemblies 670 are mechanically operated. Flap retainer arms 280 or upright plates 230 are driven pneumatically by air cylinders 278 or 278'. In the overall mechanical drive assembly (FIG. 21), motor 710 activates shafts 712, clutches 714, gear boxes 716, and chain and sprockets 718 which in turn drive mechanical assemblies 600 (controlling first ram assembly 212'), 606 (controlling advancing means 244), 612 (controlling right flap folder assemblies 314'), 614 (controlling left flap folder assembly 324'), 668 (controlling tube lifter arm assemblies 424') and 674 (controlling end wall folder assemblies 670).

Figure 27:
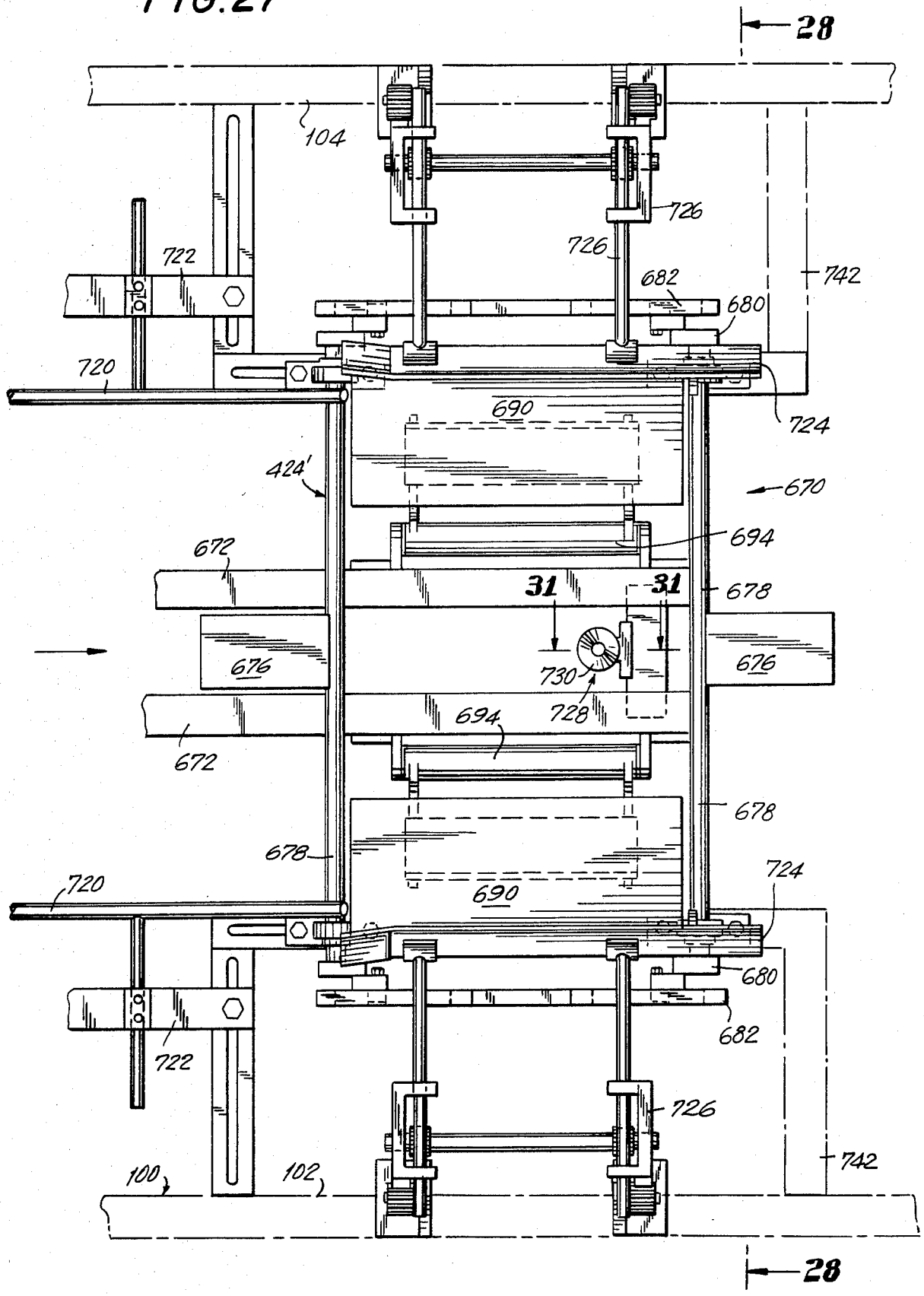
FIG. 27 is a top plan of the third folding station.
Figure 28:
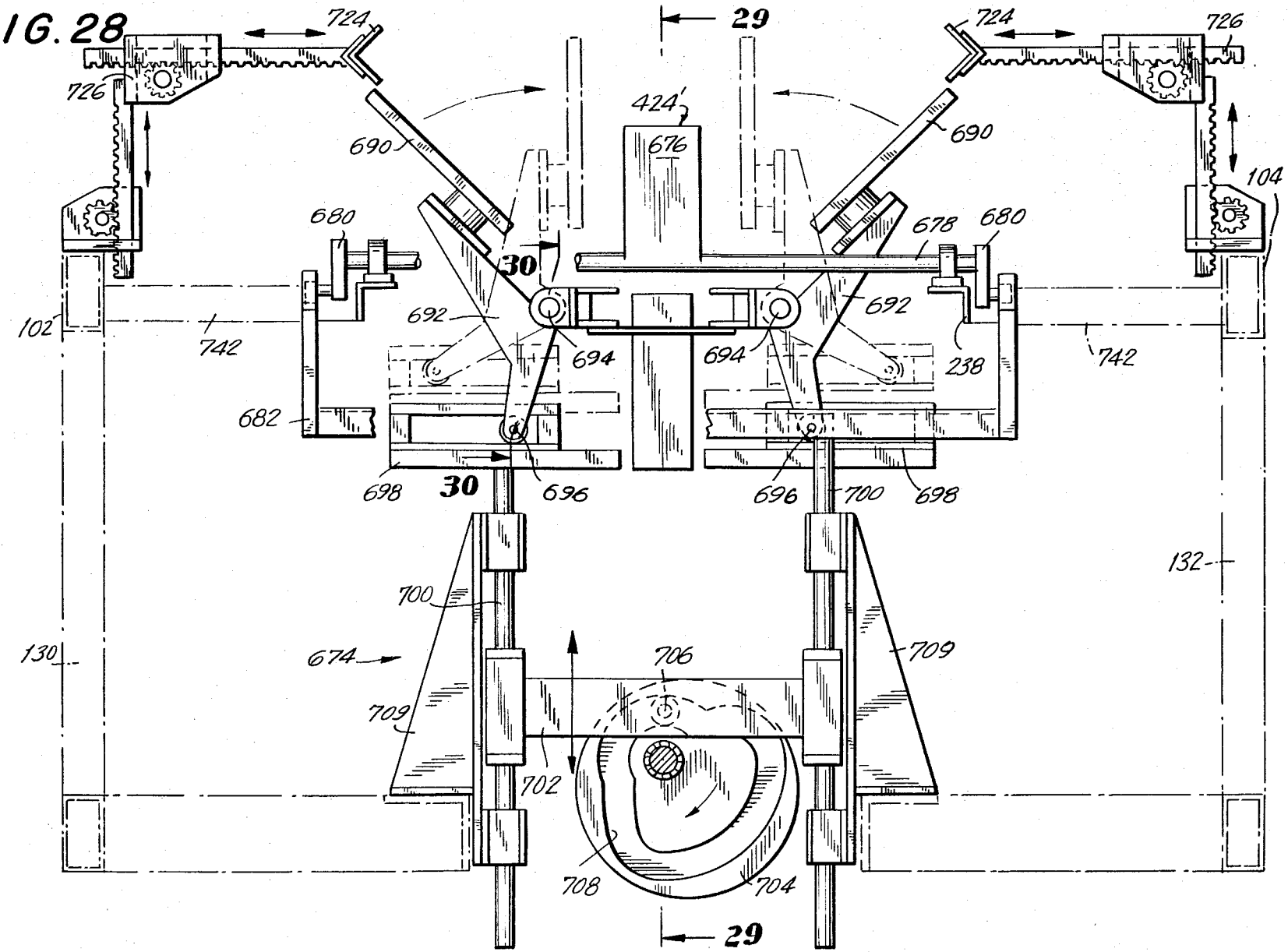
FIG. 28 is a sectional view taken along line 28—28 of FIG. 27 showing a front view of the third folding station.

A further variation on apparatus 20 is shown in FIG. 27 of the alternative embodiment. This variation provides a pair of plowing shoes 720 to guide the end walls 36 and 36' into a 45° angle between the second and third folding stations 300 and 400. Plowing shoes 720 are mounted to lower longitudinal frame members 102 and 104 in the second folding station 300 through frame mounts 722. The 45° angle of end walls 36 and 36' is maintained in the third folding station 400 by angle guides 724 mounted to frame 100 by adjustable supports 726. Because the compression pads 690 need only travel 45° to bring end walls 36 and 36' into position, time is saved and there is less wear on the box material.

Another variation is vacuum cup assembly 728 in the third folding station 400 of the alternative embodiment. Vacuum cup assembly 728 comprises vacuum cup 730, vacuum cup adapter 732, nipple 734, vacuum connector 736, air cylinder 738 and frame mount 740. Vacuum cup 730 holds the bottom wall 32 of carton 30 down so that rectangular tubes 56 and 56' and end walls 36 and 36' can be squarely erected. Since some carton blanks have a high degree of warp, the partially completed carton 30 tends to climb up in the air while being finally erected. Vacuum cup 730 therefore holds the box firmly while the final folding operations are performed. The vacuum is released as the next box advances from the second folding station 300.

Figure 5:
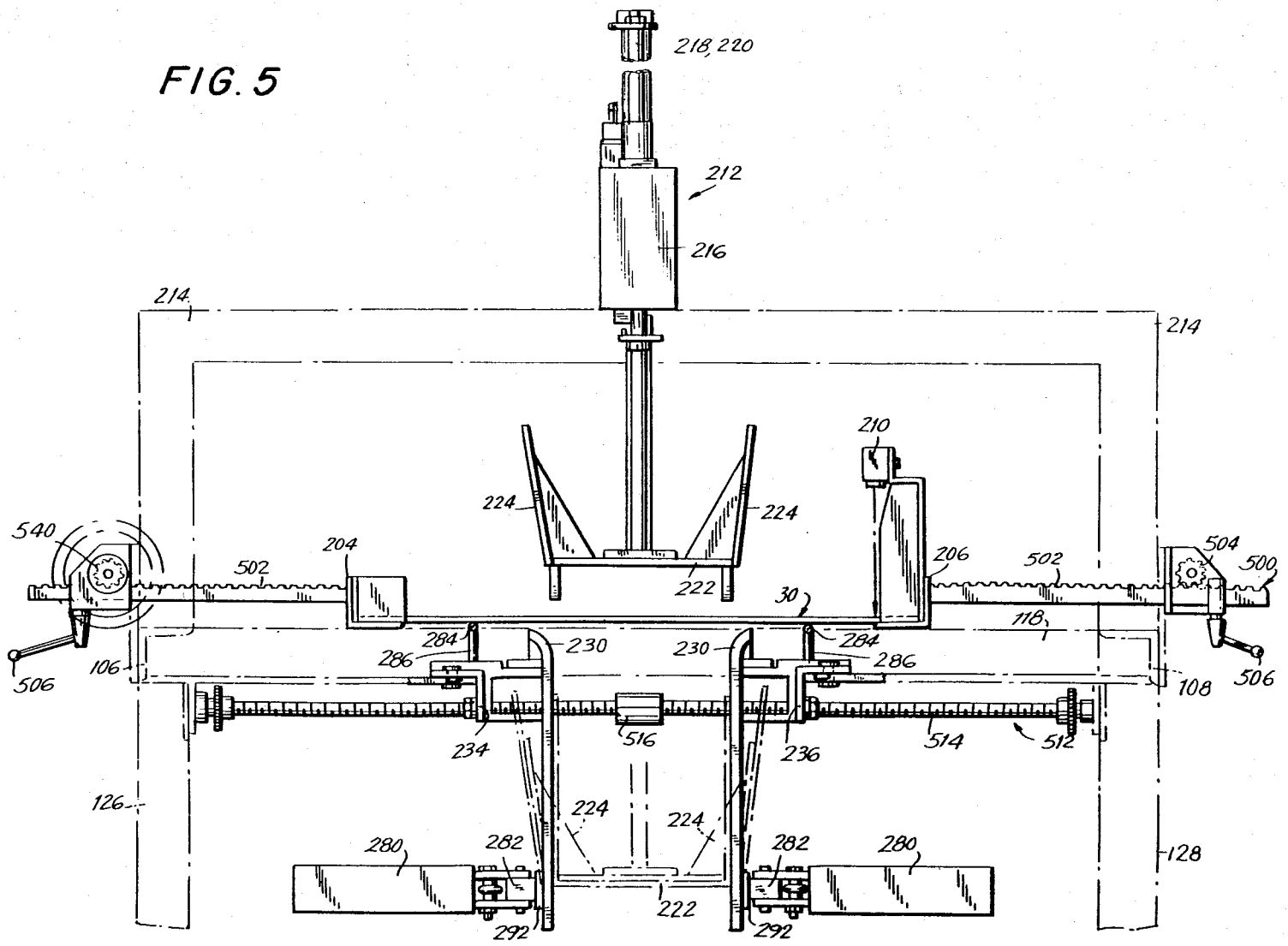
FIG. 5 is a sectional view taken along line 5—5 in FIG. 4 showing a front view of the first folding station.
Figure 6:
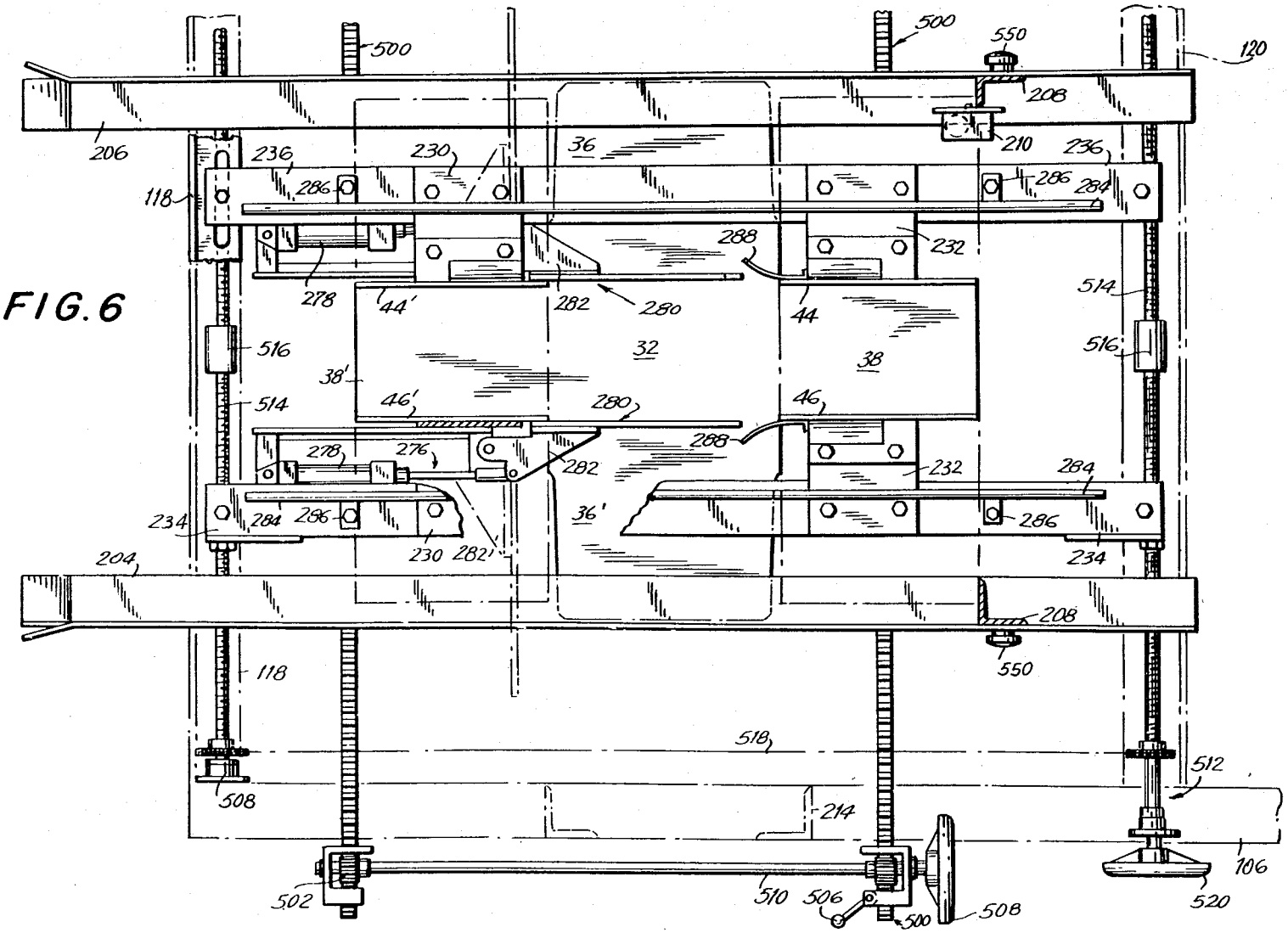
FIG. 6 is a sectional view taken along line 6—6 in FIG. 4 showing a top plan of the first folding station.

The apparatus 20 herein described can be constructed to perform the folding process on variously sized carton blanks. For example, one apparatus 20 could be constructed to erect cartons for one liter bottles and another apparatus to erect cartons for two liter bottles. However, minor adjustments in size may be made within each apparatus 20. For example, in the first folding station 200, as shown in FIGS. 5 and 6, upper guide rails 204 and 206 can be adjusted laterally by mechanical adjustment assembly 500 comprising gear rack 502, gear 504, hand knob 506, elevator mount wheel 508, and cross rod 510. Additionally, plate mounting bars 234 and 236 to which upright plates 230 and 232 are attached, can be adjusted transversely by idler assembly 512 comprising idler shafts 514, couplers 516, chains 518 and hand wheel 520. Squaring stops 208 can be adjusted along upper guide rails 204 and 206 by hand knobs 550 (FIG. 6).

In the second folding station 300, the outer guide rails 310 can be adjusted transversely by adjusting support rods 312 with hand knobs 522 (FIG. 9). In addition, the left flap folder assemblies 324 can be slid longitudinally between longitudinal frame member 102 and 106 by bars 528 and tightened by hand knobs 530.

In the third folding station 400, longitudinal support beams 440 are adjusted by idler assembly 532 (FIGS. 13 and 15) comprising idler shafts 534, coupling 536, chains 538, and hand wheel 540.

In addition, carton blanks providing upper flaps for complete enclosure of a box, as opposed to the open top type as described herein, can be constructed using apparatus 20.

I claim:

1. A method for manufacturing from a single carton blank a rectangular carton with integral interior partitions, each carton blank having a bottom wall, two end walls and two side portions, each side portion having a side wall, an upper-right flap portion, a lower-right flap portion, an upper-left flap portion, and a lower-left flap portion, the steps in sequence comprising:

feeding the carton blank into an apparatus for erecting the carton into a box;

bending the flap portions of the carton blank perpendicular to the side walls of the carton blank;

applying adhesive to the flap portions;

folding and sealing the side portions to form two open-ended rectangular tubes;

applying adhesive to the open-ended rectangular tubes;

raising the open-ended rectangular tubes to a position perpendicular to the bottom wall of the carton blank;

forcing the end walls of the carton blank to bend perpendicular to the bottom wall of the carton blank;

sealing the open-ended rectangular tubes to the end walls to form the completed carton; and ejecting the completed carton from the carton erecting apparatus.

2. The method of claim 1 wherein the step of bending the flap portions perpendicular to the side walls includes applying a downward force to the bottom and side walls of the carton blank with a first ram member causing the flap portions to contact a pair of upright plates so that as the ram continues to descend the upper and lower flap portions are forced to stand in a vertical position.

3. The method of claim 1 wherein the carton blank is advanced through the erecting apparatus by engaging a trailing side wall of the carton blank in a pusher mechanism and sliding the pusher mechanism along a track in a forward direction so that the carton blank is pushed from behind to a subsequent folding station.

4. The method of claim 1 wherein adhesive is applied to the upper-left flap portions of the carton blank between the first and second folding stations.

5. The method of claim 4 wherein the steps of folding and sealing the flap portions to form two open-ended rectangular tubes includes:

feeding the carton blank underneath a compression mandrel;

bending the upper-right flap portions into a horizontal position and onto the compression mandrel by a pivotally mounted right flap folder: and bending the previously glued upper-left flap portions into a horizontal position onto the upper-right flap portions by two pivotally mounted left flap folders.

6. The method of claim 1 wherein adhesive is applied to the right and left lower flap portions of the open-ended rectangular tubes of the carton blank between the second and third folding stations.

7. The method of claim 1 wherein the step of raising the open-ended rectangular tubes comprises activating simultaneously two tube lifter arms located under the side walls of the rectangular tubes to an upright position thereby forcing the rectangular tubes into a vertical position.

8. The method of claim 1 wherein the step of forcing the end walls of the carton blank to bend perpendicular to the bottom wall of the carton blank comprises applying a downward force to the bottom wall with a second ram member causing the end walls to contact a plate and roller member so that as the second ram member continues to descend the end walls are forced to stand in a vertical position.

9. The method of claim 1 wherein the step of sealing the open-ended rectangular tubes to the end walls to form the completed carton comprises depressing the carton blank with a second ram member to a compression area where side rollers hold the rectangular tubes to the end walls.

10. The method of claim 1 wherein the step of ejecting the completed carton comprises applying a horizontal force to a trailing side walls with a discharge ram thereby moving the completed carton along a slide tray to create a space for the next completed carton.

11. The method of claim 1 wherein the step of forcing the end walls of the carton blank to bend perpendicular to the bottom wall of the carton blank in the third folding station comprises activating simultaneously two end wall folder assemblies located under the end walls to an upright position thereby forcing the end walls into a vertical position.

12. The method of claim 1 wherein the step of sealing the open-ended rectangular tubes to the end walls to form the completed carton in the third folding station comprises holding the end walls and rectangular tubes with compression pads of a pair of end wall folder assemblies.

13. The method of claim 1 wherein the step of ejecting the completed carton comprises using a partially erected box which has been advanced from the second folding station into the third folding station to force the completed box out of the third folding station.

14. An apparatus for manufacturing from a single carton blank a rectangular carton with integral interior partitions, each carton blank having a bottom wall, two end walls and two side portions, each side portion having a side wall, an upper-right flap portion, a lower-right flap portion, an upper-left flap portion, and a lower-left flap portion, comprising:

a frame for supporting the apparatus;

a blank feeding station;

a first folding station located at the end of the frame adjacent to the blank feeding station;

means located in the first folding station for bending the flap portions of the carton blank perpendicular to the side walls of the carton blank;

a second folding station located substantially in the middle of the frame;

folding means located in the second folding station for folding and sealing each side portion of the carton blank into an open-ended rectangular tube;

a third folding station located at the end of the frame farthest from the blank feeding station;

means located in the third folding station for raising the open-ended rectangular tubes to a position perpendicular to the bottom wall of the carton blank;

means located in the third folding station for bending the end walls of the carton blank perpendicular to the bottom wall of the carton blank;

means located in the third folding station for sealing the open-ended rectangular tubes to the end walls to form the completed carton;

means located in the third folding station for ejecting the completed cartons;

means located in the first and second folding stations for advancing the carton blank between the first, second and third folding stations;

means located between the first, second and third folding stations for applying glue to the carton blank.

15. The apparatus as described in claim 14 wherein the first folding station comprises:

an upper pair of parallel guide rails affixed to the frame and extending the length of the first folding station for receiving the carton blank from the blank feeding station;

a pair of stop means located on the upper guide rails for positioning the carton blank within the first folding station;

a lower pair of parallel guide rails affixed to the frame and extending the entire length of the frame for receiving the partially erected carton blank after the flap portions are forced into a vertical position;

a pair of support tracks affixed to the frame running parallel to and between the lower guide rails extending the length of the first and second folding stations for supporting the carton blank; and a pair of flap retainer arms pivotally affixed to the frame which retract inwardly for maintaining the flap portions in a vertical position when the carton blank is advanced between the first and second folding stations.

16. The apparatus as described in claim 14 wherein the third folding station comprises:

a lower pair of parallel guide rails affixed to the frame and extending the entire length of the frame;

a pair of plate mounting bars affixed to the frame; and a pair of upstanding stop members located on each lower guide rail for positioning the carton blank in the third folding station.

17. The apparatus as described in claim 16 wherein the means for raising the open-ended rectangular tubes comprises a pair of tube lifter arms pivotally mounted on the frame and positioned under the side walls of the rectangular tubes which extend to an upright position thereby folding the rectangular tubes into a vertical position.

18. The apparatus as described in claim 17 wherein the means for bending the end walls comprises:

a second ram member mounted at the top of the third folding station for applying a downward movement to the bottom wall of the carton blank; and a pair of fixed side plate members affixed to the plate mounting bars for forcing the end walls into a vertical position as the second ram member descends.

19. The apparatus as described in claim 18 wherein the means for sealing the open-ended rectangular tubes to the end walls comprises:

a compression area located at the bottom of the third folding station where the carton blank is driven by the second ram member;

a slide tray located at the bottom of the compression area for receiving the completed carton; and a series of rollers in the compression area which hold the end walls in contact with the rectangular tubes to form the completed carton.

20. The apparatus as described in claim 19 wherein the means for ejecting the completed carton comprises:

a discharge ram mounted to the frame in the compression area for applying a horizontal force to a trailing side wall of the completed carton to move the completed carton along the slide tray to make room for the next descending completed carton.

21. The apparatus as described in claim 14 wherein the means for advancing the carton blank comprises:

a central carriage assembly extending the length of the first and second folding stations;

a pair of support tracks on either side of the central carriage assembly;

a first pusher means mounted on the central carriage assembly in the first folding station for engaging a trailing side wall of the carton blank and delivering the carton blank to the second folding station as the central carriage assembly rolls along the support tracks; and a second pusher means mounted on the central carriage assembly in the second folding station for engaging the trailing side wall of the carton blank and delivering the carton blank to the third folding station as the central carriage assembly rolls along the support tracks.

22. The apparatus as described in claim 14 wherein the means located in the first folding station for bending the flap portions comprises:

a first ram assembly mounted on the frame above the first folding station for applying a downward movement to the bottom and side walls of the carton blank; and two pairs of vertical plates mounted on the frame positioned to force the flap portions into a vertical position as the ram assembly pushes the carton blank downward.

23. The apparatus as described in claim 14 wherein the second folding station comprises:

a lower pair of parallel guide rails affixed to the frame and extending the entire length of the frame;

a pair of support tracks affixed to the frame and extending the length of the first and second folding stations for supporting the carton blank;

a retractable stop rod located on the lower guide rails for positioning the carton blank in the second folding station;

a compression mandrel adjustably affixed to the frame and extending the length of the carton blank around which the flap portions are folded to form the open-ended rectangular tubes; and a pair of adjustable guide rails attached to the frame and running on either side of the compression mandrel for maintaining the lower flap portions in a vertical position.

24. The apparatus as described in claim 23 wherein the folding means in the second folding station comprises:

a right flap folder pivotally mounted on the frame for applying an inward force to the upper-right flap portions to bring the upper-right flap portions to a horizontal position onto the compression mandrel and a pair of left flap folders pivotally mounted on the frame for applying an inward force to the upper-left flap portions to bring the upper-left flap portions into a horizontal position and onto the previously folded upper-right flap portions to form two open-ended rectangular tubes.

25. The apparatus as described in claim 14 wherein the means located in the third folding station for raising the open-ended rectangular tubes comprises tube lifter arm assemblies pivotally mounted to the frame and positioned under the side walls of the open-ended rectangular tubes which extend to an upright position thereby erecting the open-ended rectangular tubes to a position perpendicular to the bottom wall of the carton blank.

26. The apparatus as described in claim 25 wherein the means located in the third folding station for bending the end walls and sealing the end walls to the open-ended rectangular tubes comprises end wall folder assemblies pivotally mounted to the frame and positioned under the end walls which extend to an upright position thereby folding the end walls into a position perpendicular to the bottom wall of the carton blank and holding the end walls to the open-ended rectangular tubes.

27. The apparatus as described in claim 26 which further comprises a vacuum cup in the third folding station for holding the bottom wall of the carton in a secure position while folding the open-ended rectangular tubes and end walls to produce the completed carton.

28. The apparatus as described in claim 14 which further comprises a pair of plowing shoes between the second and third folding stations for guiding the end walls into a 45° angle in the third folding station.

* * * * *